US008152271B2

(12) United States Patent
Mitsuhashi et al.

(10) Patent No.: US 8,152,271 B2
(45) Date of Patent: Apr. 10, 2012

(54) LIQUID EJECTING APPARATUS

(75) Inventors: Masato Mitsuhashi, Hara-mura (JP); Makoto Kawamoto, Matsumoto (JP); Koji Higuchi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 475 days.

(21) Appl. No.: 12/411,590

(22) Filed: Mar. 26, 2009

(65) Prior Publication Data

US 2009/0244245 A1 Oct. 1, 2009

(30) Foreign Application Priority Data

Apr. 1, 2008 (JP) ..... 2008-095282

(51) Int. Cl.
*B41J 2/165* (2006.01)
*B41J 2/01* (2006.01)

(52) U.S. Cl. ..... 347/35; 347/20; 347/22; 347/34; 347/101; 347/104

(58) Field of Classification Search ..... 347/34, 347/35, 101, 104
See application file for complete search history.

(56) References Cited

U.S. PATENT DOCUMENTS

2007/0046723 A1* 3/2007 Matsuhashi ..... 347/32

FOREIGN PATENT DOCUMENTS

JP 2006-272554 * 10/2006

* cited by examiner

*Primary Examiner* — Ryan Lepisto
(74) *Attorney, Agent, or Firm* — Workman Nydegger

(57) ABSTRACT

A liquid ejecting apparatus includes a liquid ejecting head disposed on a transport path of a target to eject a liquid from nozzles at a nozzle forming surface, a target transport unit transporting the target such that the target passes through a position opposite the nozzle forming surface on the transport path, and a liquid receptor transport unit transporting a liquid receptor for receiving the liquid ejected from the nozzles as a waste liquid such that the liquid receptor passes through the position opposite the nozzle forming surface on the transport path. With rotation of the target transport unit, a mechanism unit including a target transport member for transporting the target in a transport direction is able to be attached and detached at a position out of a mechanism portion of the liquid receptor transport unit with respect to the liquid ejecting apparatus.

5 Claims, 10 Drawing Sheets

LIQUID EJECTING APPARATUS

CROSS-REFERENCE TO RELATED APPLICATION

The entire disclosure of Japanese Patent Application No. 2008-095282, filed Apr. 1, 2008 is expressly incorporated by reference herein.

BACKGROUND

1. Technical Field

The present invention relates to a liquid ejecting apparatus, and in particular, to a liquid ejecting apparatus that enables a liquid, which is ejected from a liquid ejecting head as a waste liquid, to be received by a liquid receptor, which is transported to a position opposite a nozzle forming surface of the liquid ejecting head.

2. Related Art

An ink jet type printer (hereinafter, referred to as "printer") is known as an example of liquid ejecting apparatuses that eject a liquid onto a target. This printer ejects ink (liquid), which is supplied to a recording head (liquid ejecting head), from nozzles at a nozzle forming surface of the recording head toward a recording sheet (target), thereby performing printing. In such a printer, if ink is not ejected from the nozzles for a long time, the surface of an ink meniscus at each nozzle may be dried, and poor ink ejection may occur. For this reason, in such a printer, when printing is not performed, so-called flushing is performed so as to forcibly eject ink from the nozzles on the basis of a control signal unrelated to printing.

A serial or lateral type printer is known in which a recording head ejects ink while reciprocating along a transport plane of a recording sheet when printing is performed. In this printer, when printing is not performed, the recording head moves to a flushing position out of the recording sheet, and flushing is performed toward a cap or a flushing box provided at the flushing position. However, in a line head type printer, in which a recording head is provided over the entire sheet width in a direction perpendicular to a transport direction of a recording sheet on a transport path of the recording sheet without moving along the transport plane of the recording sheet, the recording head cannot be moved to the flushing position out of the recording sheet.

In general, in the line head type printer, a sheet-like ink receiving member (liquid receptor) receiving ink ejected from the recording head is transported to a position opposite the nozzle forming surface of the recording head with timing different from a transport timing of the recording sheet by an exclusive-use transport mechanism of the ink receiving member (for example, see JP-A-2006-272554 (FIGS. 14 and 15)).

In the printer described in JP-A-2006-272554, the recording sheet is transported from an upstream side to a downstream side along the transport plane of the recording head parallel to the nozzle forming surface by an endless transport belt (target transport unit), and ink is ejected for printing when the recording sheet passes below the nozzle forming surface. A pair of left and right ring-shaped bodies (mobile members) having endless chains are provided on the left and right sides of the transport belt such that a part of a circular movement path thereof overlaps the transport path of the recording sheet by the transport belt. The sheet-like ink receiving member (liquid receptor) is supported in a stretched state between both ring-shaped bodies through an elastically deformable wire-like connection member (support member). When the ink receiving member circularly moves by circular movement of the ring-shaped bodies and passes through a position opposite the nozzle forming surface of the recording head, the ink receiving member is located at a position opposite the nozzle forming surface to receive ink ejected from the nozzles of the recording head for flushing.

In many cases, the transport belt transporting the recording sheet is formed of rubber. Accordingly, the transport belt is deteriorated with age. In addition, since the transport belt passes through the position opposite the nozzle forming surface while the recording sheet, onto which ink is ejected, is placed thereon, ink may be stuck to the transport belt. For this reason, with respect to the transport belt, a maintenance work, such as replacement or cleaning, is frequently needed.

In general, the transport belt is circularly wound around a plurality of pulleys, and accordingly the pulleys need to be removed. The pulleys are disposed coaxially with sprockets with chains wound therearound. In this case, other parts, such as sprockets with chains wound therearound and the like, also need to be removed. As a result, the maintenance work becomes complicated.

SUMMARY

An advantage of some aspects of the invention is that it provides a liquid ejecting apparatus capable of simply performing various maintenance works including replacement or cleaning of a target transport member without removing a liquid receptor transport unit.

According to an aspect of the invention, a liquid ejecting apparatus includes a liquid ejecting head disposed on a transport path of a target to eject a liquid from nozzles at a nozzle forming surface, a target transport unit transporting the target such that the target passes through a position opposite the nozzle forming surface on the transport path, and a liquid receptor transport unit transporting a liquid receptor for receiving the liquid ejected from the nozzles as a waste liquid such that the liquid receptor passes through the position opposite the nozzle forming surface on the transport path. With rotation of the target transport unit, a mechanism unit including a target transport member for transporting the target in a transport direction is able to be attached and detached at a position out of a mechanism portion of the liquid receptor transport unit with respect to the liquid ejecting apparatus.

With this configuration, for maintenance of the target transport unit, the target transport unit can be removed from the liquid ejecting apparatus on a mechanism unit basis, and maintenance can be performed. Therefore, various maintenance works including replacement or cleaning of the target transport member can be simply performed without removing the liquid receptor transport unit.

In the liquid ejecting apparatus according to the aspect of the invention, the target transport member may be an endless transport belt. The mechanism unit may include a plurality of pulleys around which the transport belt is wound so as to form a circular path, and a support rotatably supporting the pulleys. The mechanism unit may be handled integrally on a mechanism unit basis in a state where the pulleys are rotatably combined with the support and the transport belt is wound between the pulleys.

With this configuration, even if the mechanism unit of the target transport unit is formed by a plurality of members including the transport belt, the pulleys, and the supports, by holding the support, the entire mechanism unit can be simply attached and detached with respect to the liquid ejecting apparatus.

In the liquid ejecting apparatus according to the aspect of the invention, the liquid receptor transport unit may include an endless mobile member moving along a circular movement path to transport the liquid receptor. The mechanism unit in the target transport unit may be able to be attached and detached inside the circular movement path of the mobile member in the liquid receptor transport unit.

With this configuration, the target transport unit is disposed inside the circular movement path defined by the mobile member in the liquid receptor transport unit. Therefore, the liquid ejecting apparatus can be reduced in size.

In the liquid ejecting apparatus according to the aspect of the invention, the mechanism unit may be attached and detached with respect to the liquid ejecting apparatus by moving the entire mechanism unit along an axis when the target transport member rotates.

With this configuration, even if a constituent element of the mechanism unit of the target transport unit is disposed near a mechanism portion of the liquid receptor transport unit, the entire mechanism unit can be easily attached and detached without interfering with the mechanism portion of the liquid receptor transport unit.

The liquid ejecting apparatus according to the aspect of the invention may further include an attachment/detachment portion, into and from which a part of the mechanism unit is able to be inserted and withdrawn when the mechanism unit is moved to be attached and detached.

With this configuration, when the mechanism unit of the target transport unit is attached and detached for maintenance, attachment/detachment can be simply made only by moving the mechanism unit in an insertion/withdrawal direction with respect to the attachment/detachment portion in the liquid ejecting apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention implemented in an ink jet type printer will be described with reference to FIGS. 1 to 10. In the following description, the "up-down direction", the "front-back direction", and the "left-right direction" are based on the directions indicated by arrows in FIGS. 1 to 8.

Figure 1:
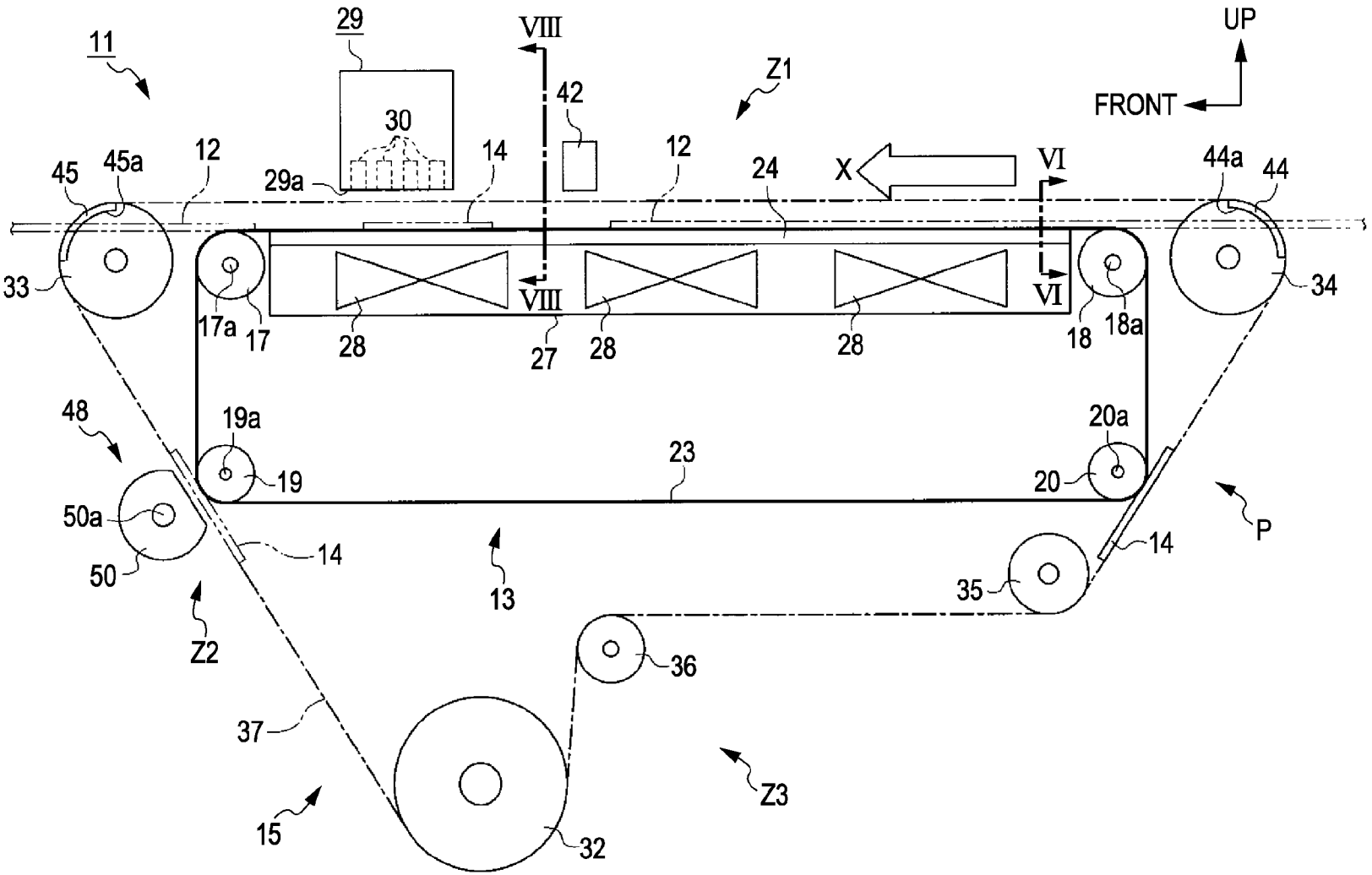
FIG. 1 is a schematic view of a printer.

As shown in FIG. 1, an ink jet type printer (hereinafter, referred to as "printer") 11 serving as a liquid ejecting apparatus includes a sheet transport mechanism (target transport unit) 13 that is driven to transport a sheet (target) 12, and a sheet transport mechanism (liquid receptor transport unit) 15 that is driven to transport a maintenance sheet (liquid receptor) 14.

The sheet transport mechanism 13 is provided with a driving pulley 17 that is driven to rotate around an axis along a left-right direction on the basis of a driving force of a sheet transport motor (first driving source) 16 (see FIG. 10), and a driven pulley 18 that freely rotates around an axis parallel to the axis of the driving pulley 17 while being aligned with the driving pulley 17 at the back of the driving pulley 17. Two tension pulleys 19 and 20 are provided below the driving pulley 17 and the driven pulley 18, respectively. The two tension pulleys 19 and 20 freely rotate around the axes parallel to the pulleys 17 and 18, respectively, and are urged such that the axial center of which moves downward. The pulleys 17 to 20 are provided such that both ends of shaft portions 17*a*, 18*a*, 19*a*, and 20*a* thereof are supported by a pair of support plates 21 and 22 (see FIGS. 2 and 3), which are provided in parallel in the left-right direction.

As shown in FIG. 1, an endless transport belt (target transport member) 23 is wound around the pulleys 17 to 20 in the sheet transport mechanism 13 so as to form a substantially rectangular ring-shaped circular path with tension applied thereto by the tension pulleys 19 and 20. The transport belt 23 is configured to circularly move in a counterclockwise direction of FIG. 1 by rotation of the driving pulley 17. In this way, the sheet 12 is transported forward, that is, in a transport direction X indicated by a white arrow line of FIG. 1. That is, the sheet transport mechanism 13 transports the sheet 12, which is fed from a sheet feed tray (not shown) located at the back of the driven pulley 18 onto the transport belt 23, forward by circular movement of the transport belt 23, such that the sheet 12 is discharged to a sheet discharge tray (not shown) in front of the driving pulley 17.

Figure 2:
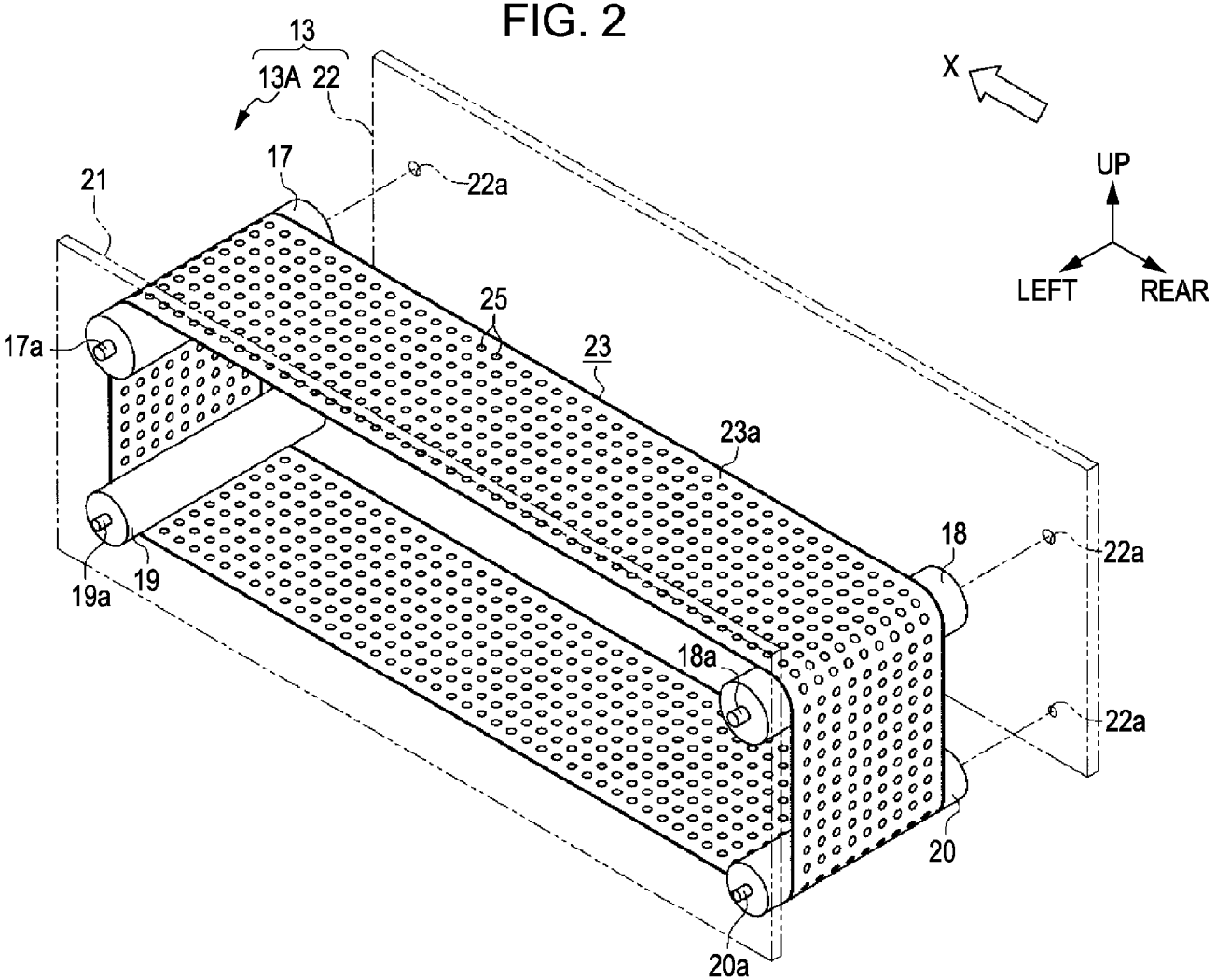
FIG. 2 is a schematic perspective view of a sheet transport mechanism.

As shown in FIG. 2, of both the left and right support plates 21 and 22 in the sheet transport mechanism 13, the left-side first support plate (support) 21 is detachably mounted at a position out of a mechanism portion of the sheet transport mechanism 15 with respect to a main body frame (not shown) of the printer 11. The right-side second support plate 22 is undetachably fixed with respect to the main body frame (not shown) of the printer 11. The left ends of the shaft portions 17*a* to 20*a* of the pulleys 17 to 20 are supported so as not to be inserted and withdrawn with respect to shaft receiving portions (not shown) in the first support plate 21 while the pulleys 17 to 20 are kept to freely rotate. The right ends of the shaft portions 17*a* to 20*a* of the pulleys 17 to 20 are supported so as to be inserted and withdrawn with respect to shaft receiving portions (attachment/detachment portions) 22*a* defined by holes or openings in the second support plate 22.

That is, the sheet transport mechanism 13 is configured such that if a user holds the first support plate 21 and moves the first support plate 21 in the left-right direction, a mechanism unit 13A, in which the first support plate 21, the pulleys 17 to 20, and the transport belt 23 are included so as to be integrally handled, is freely attached and detached with respect to the printer 11. At the time of attachment/detachment, the user holds the first support plate 21 serving as a holding portion and moves the entire mechanism unit 13A along the axes of the shaft receiving portions 22*a*, which become attachment/detachment portions, thereby performing attachment/detachment.

Figure 3:
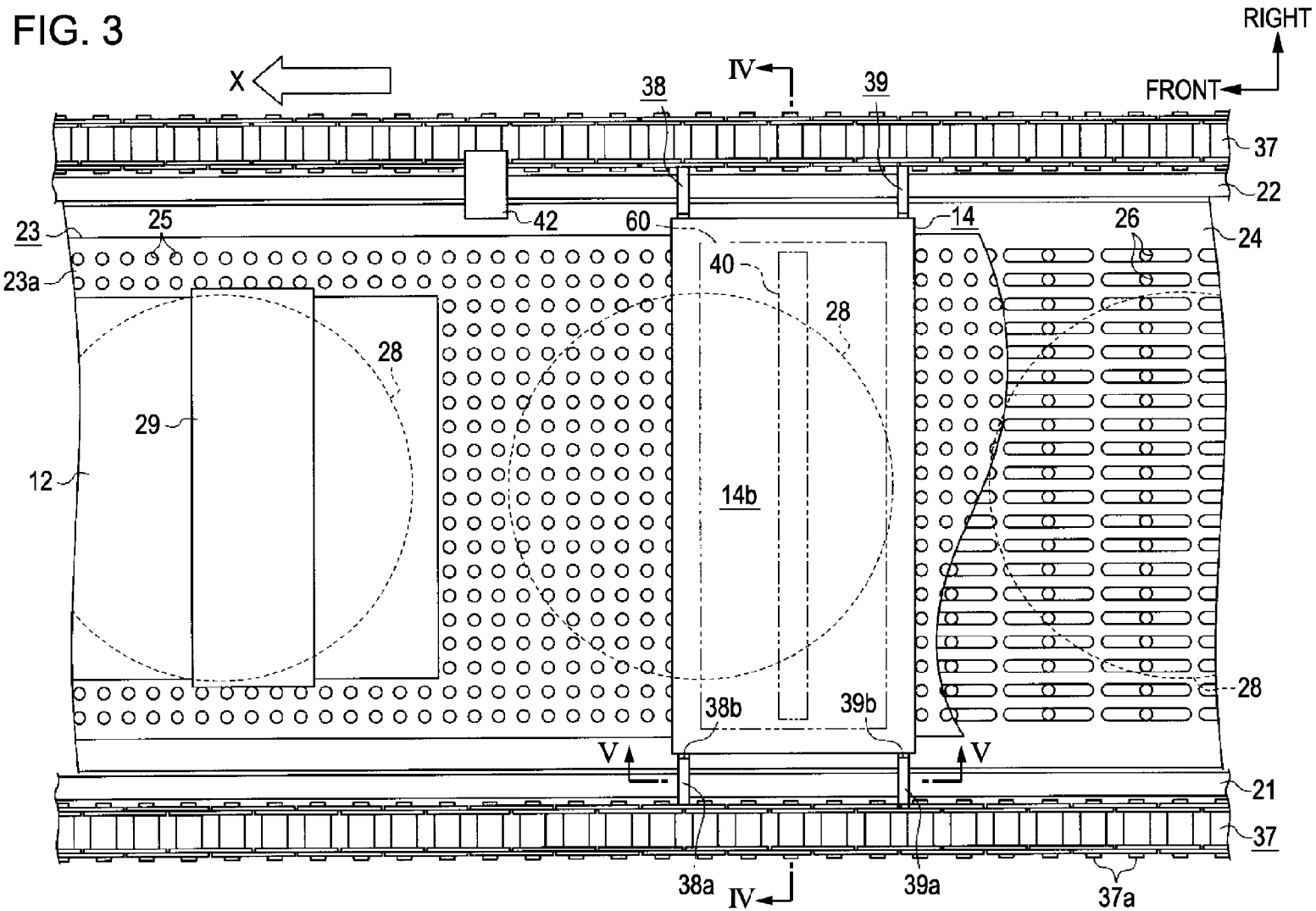
FIG. 3 is a partial schematic plan view of a printer.

As shown in FIGS. 1 and 3, a platen 24 is provided at a position between the driving pulley 17 and the driven pulley 18 and at a position between both the left and right support plates 21 and 22, such that a planar upper surface thereof is aligned with a top portion of a circumferential surface of each of the driving pulley 17 and the driven pulley 18. When the transport belt 23 circularly moves, a rear surface of a belt portion, which is transported in the transport direction X with the sheet 12 placed thereon, in the transport belt 23 slides with respect to the upper surface of the platen 24.

As shown in FIG. 3, the transport belt 23 is formed to have a width larger than the width of the sheet 12. The belt portion sliding on the platen 24 forms the transport path of the sheet 12 between the driving pulley 17 and the driven pulley 18. A surface 23*a* of the belt portion forms a transport plane when the sheet 12 is transported in the transport direction X. A plurality of circular air holes 25 are formed in the transport belt 23 so as to pass through between the surface 23*a* and a rear surface in slide contact with the upper surface of the platen 24. The air holes 25 are formed regularly so as to be arranged in a lattice shape at regular intervals in the front-back direction and the left-right direction.

A plurality of vacuum holes 26 are formed in the platen 24 so as to pass through the platen 24 in the up-down direction (a thickness direction of the platen 24). The vacuum holes 26 are formed at positions corresponding to the air holes 25 of the transport belt 23 in the left-right direction and at intervals (for example, approximately three times) wider than the intervals between the air holes 25 in the front-back direction. An opening on an upper side in each of the vacuum holes 26 is formed to have a long groove shape along the front-back direction.

As shown in FIG. 1, a boxlike suction portion 27 for sucking the vacuum holes 26 is provided below the platen 24 so as to cover the openings of the vacuum holes 26 at a lower surface of the platen 24. A plurality of fans (in this embodiment, three fans) 28 are provided in the suction portion 27. If the fans 28 are driven, the vacuum holes 26 are sucked and have negative pressure. When this happens, a downward suction force is given to the sheet 12 placed on the transport belt 23 through the air holes 25 communicating with the long groove-shaped openings of the vacuum holes 26.

As shown in FIGS. 1 and 3, a recording head (liquid ejecting head) 29 for ejecting ink serving as a liquid is provided at a position corresponding to a front portion of the platen 24 and above the transport belt 23 (on the transport path) such that a nozzle forming surface 29*a* serving as a lower surface of the recording head 29 is opposite the surface 23*a* of the transport belt 23. The recording head 29 is provided such that the longitudinal direction thereof extends in the left-right direction perpendicular to (intersecting) the transport direction X of the sheet 12. The dimension of the recording head 29 in the longitudinal direction is longer than the dimension of the sheet 12 in the widthwise direction (the left-right direction).

A plurality of nozzles 30 are formed at the nozzle forming surface 29*a* of the recording head 29 such that a plurality of nozzle columns (in FIG. 1, four nozzle columns) are arranged at predetermined intervals in the transport direction X (the front-back direction) over the widthwise direction of the sheet 12 (the left-right direction). That is, the recording head 29 is a so-called full line type recording head (line head) in which ink is ejected onto the sheet 12 passing a position opposite the nozzle forming surface 29*a* in the transport direction X over the entire widthwise direction of the sheet 12, thereby performing printing. A slight (for example, approximately 1 mm) gap is set between the nozzle forming surface 29*a* of the recording head 29 and the surface 23*a* (transport plane) of the transport belt 23 such that, when ink is ejected from the nozzles 30 of the nozzle forming surface 29*a* onto the surface of the sheet 12, ink droplets are reliably landed at intended positions of the sheet 12.

Next, as shown in FIG. 1, a driving sprocket 32 is provided in the sheet transport mechanism 15 at a downward position opposite to the recording head 29 with the platen 24 interposed therebetween and below the circular path of the transport belt 23 in the sheet transport mechanism 13. The driving sprocket 32 is driven to rotate around the axis parallel to each of the pulleys 17 to 20 of the sheet transport mechanism 13 on the basis of a driving force of a sheet transport motor (second driving source) 31 (see FIG. 10).

A pair of front and back driven sprockets 33 and 34 are provided at positions in front of the driving pulley 17 and at the back of the driven pulley 18 in the sheet transport mechanism 13 so as to freely rotate around an axis parallel to the axis of the driving sprocket 32. A relay sprocket 35 and a tension sprocket 36, which is urged such that the axial center thereof move upward, are provided between the driving sprocket 32 and the back driven sprocket 34 so as to freely rotate around an axis parallel to the axis of the driving sprocket 32.

The sprockets 32 to 36 are provided on left and right outer sides of the sheet transport mechanism 13 (specifically, left and right outer sides of both the left and right support plates 21 and 22 axially supporting the pulleys 17 to 20) coaxially and in pairs on the left and right sides. As shown in FIG. 1, endless chains (mobile members or chain members) 37 are wound around the pairs of left and right sprockets 32 to 36 with tension applied thereto by the tension sprocket 36 so as to be provided circularly around the circular path of the transport belt 23 in the sheet transport mechanism 13.

Figure 4:
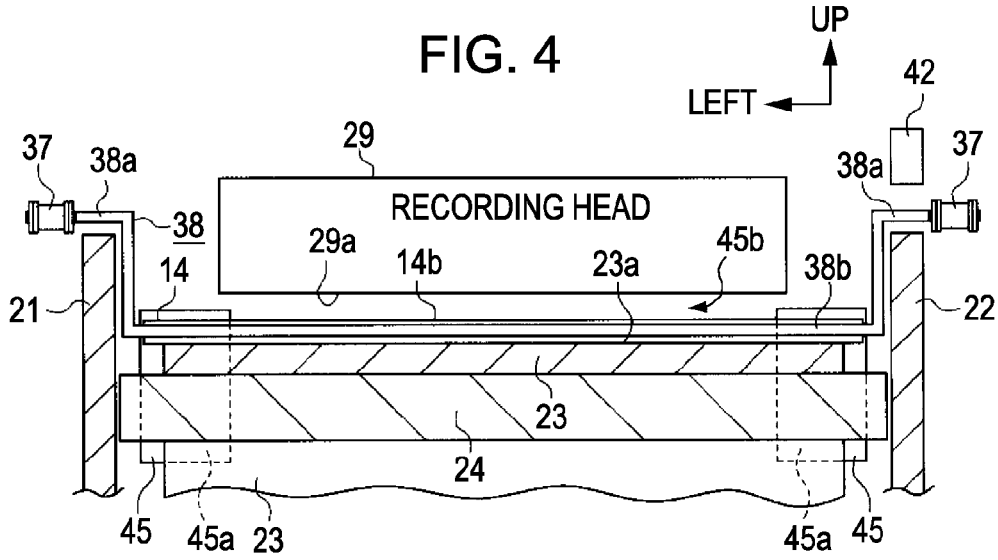
FIG. 4 is a sectional view taken along the line IV-IV of FIG. 3.

That is, the sheet transport mechanism 15 is provided such that the chains 37 move along the circular movement path with the sheet transport motor 31 different from the sheet transport motor 16 as a driving source outside the circular path of the transport belt 23, which circularly moves with the sheet transport motor 16 in the sheet transport mechanism 13 as a driving source. The chains 37 are configured to circularly move in the counterclockwise direction of FIG. 1 by rotation of the driving sprocket 32. As shown in FIG. 4, the chains 37 are configured to move a space area, which is a space area above a side opposite to the surface 23*a* (transport plane) of the transport belt 23 when viewed from the nozzle forming surface 29*a* of the recording head 29 and above the upper end surfaces of both the left and right support plates 21 and 22 in the sheet transport mechanism 13, in the transport path of the sheet 12 between the front and back driven sprockets 33 and 34.

As shown in FIGS. 3 and 4, a plurality of rigid strip-shaped sheet metal members (support members) (in this embodiment, a pair of front and back sheet metal members) 38 and 39 are provided between the two chains 37 in the circular movement direction of the chains 37 at an interval larger than the width in the front-back direction of the nozzle forming surface 29*a* in the recording head 29. Specifically, both end portions (connection portions) 38*a* and 39*a* of the respective sheet metal members 38 and 39 are connected to two connection pieces 37*a* away from each other by a distance corresponding to the interval in the circular movement direction of the chains 37 from among a plurality of rigid connection pieces 37*a* forming the chains 37 in a closed chain shape.

As shown in FIG. 4, the sheet metal members 38 and 39 are bent in a crank shape such that intermediate portions (support portions) 38*b* and 39*b* in the longitudinal direction thereof have a linear shape at positions slightly inner than both end portions 38*a* and 39*a* (specifically, at positions inside the left and right support plates 21 and 22) on an inner circumferential side of the circuit movement path (circular path) of the chains 37 from both end portions 38*a* and 39*a*, respectively. That is, when the chains 37 circularly move, the sheet metal members 38 and 39 are configured such that the intermediate portions 38*b* and 39*b*, rather than both end portions 38*a* and 39*a* connected to the connection pieces 37*a* of the chains 37, move on the inner circumferential side of the circular path.

As a result, when the sheet metal members 38 and 39 pass through arc-shaped curved path portions corresponding to the outer circumferences of the driven sprockets 33 and 34 by circular movement of the chains 37, the movement velocity of the intermediate portions 38*b* and 39*b*, which move on the inner circumferential side, becomes slower than the movement velocity of both end portions 38*a* and 39*a*, which move on the outer circumferential side, due to an inner wheel difference. In other words, when the sheet metal members 38 and 39 pass through a linear path portion between both the front and back driven sprockets 33 and 34 and the like during circular movement, the intermediate portions 38*b* and 39*b* and both end portions 38*a* and 39*a* move at the same velocity. Meanwhile, when the sheet metal members 38 and 39 pass through the arc-shaped curved path portions continuous to the linear path portion on the upstream side and the downstream side of the linear path portion, a difference in velocity occurs between the intermediate portions 38*b* and 39*b* and both end portions 38*a* and 39*a*.

As shown in FIGS. 3 and 4, when the sheet metal members 38 and 39 move in the transport direction X along the transport path of the sheet 12 by the circular movement of the chains 37, the intermediate portions 38*b* and 39*b* inside both end portions 38*a* and 39*a* linearly extend in a direction perpendicular to (intersecting) the transport direction X and a direction along the surface 23*a* (transport plane) of the transport belt 23. While the sheet metal members 38 and 39 are moving in the transport direction X, both end portions 38*a* and 39*a* connected to the connection pieces 37*a* of the chains 37 move a space area on a side opposite to the surface 23*a* (transport plane) of the transport belt 23 when viewed from the nozzle forming surface 29*a*. Meanwhile, the intermediate portions 38*b* and 39*b* move a space area on the surface 23*a* side of the transport belt 23 when viewed from the nozzle forming surface 29*a*. In this case, the intermediate portions 38*b* and 39*b* forming the linear shapes of the sheet metal members 38 and 39 are formed to be close to the surface 23*a* of the transport belt 23 at a very slight gap (for example, 1 mm or less). The maintenance sheet 14 having a water-repellant and flexible sheet material 14A is supported by the intermediate portions 38*b* and 39*b* of the respective sheet metal member 38 and 39.

Figure 5:
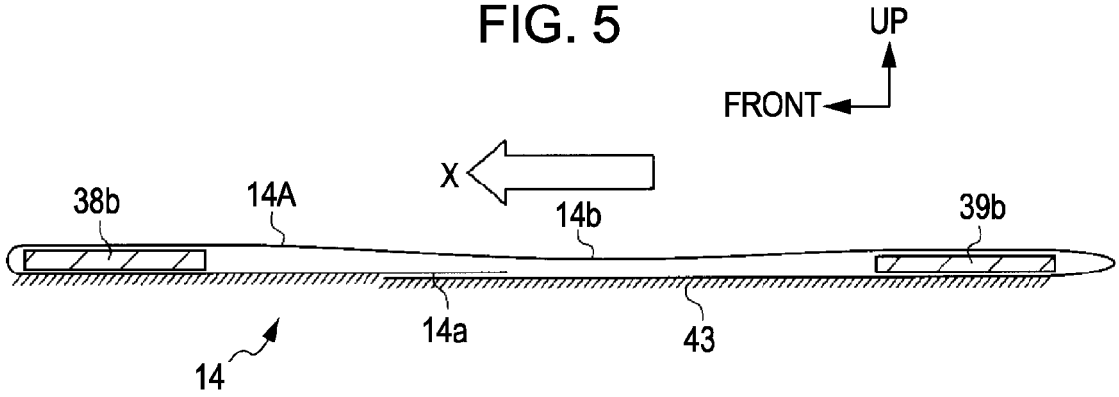
FIG. 5 is a sectional view taken along the line V-V of FIG. 3.

As shown in FIG. 5, the maintenance sheet 14 is formed by a single sheet material 14A, and the sheet material 14A is wound around the sheet metal members 38 and 39 so as to wrap from the intermediate portion 38*b* of the front (in this case, first) sheet metal member 38 to the intermediate portion 39*b* of the back (in this case, last) sheet metal member 39 in an endless shape. The maintenance sheet 14 is supported in an endless stretched state by the intermediate portions 38*b* and 39*b* of both the sheet metal members 38 and 39 by overlapping both ends of the sheet material 14A on the inner circumferential side (the lower side in FIG. 5) when the maintenance sheet 14 moves along the circular movement path in the wound state and bonding the overlap portions 14*a* to each other. That is, the maintenance sheet 14 is configured to receive waste ink (waste liquid) from the nozzles 30 of the recording head 29 at a position opposite the nozzle forming surface 29*a* of the recording head 29 while being supported in the stretched state by both the sheet metal members 38 and 39 with the circular movement of the chains 37.

As described above, when the maintenance sheet 14 passes through the position opposite the nozzle forming surface 29*a* of the recording head 29 in the stretched state, the sheet material 14A of the maintenance sheet 14 is interposed between the intermediate portions 38*b* and 39*b* of the sheet metal members 38 and 39 and the nozzle forming surface 29*a*. For this reason, even if the intermediate portions 38*b* and 39*b* of the sheet metal members 38 and 39 vibrate in the up-down direction while the sheet metal members 38 and 39 are moving, there is no case in which the intermediate portions 38*b* and 39*b* of the sheet metal members 38 and 39 come into direct contact with the nozzle forming surface 29*a* of the recording head 29. In addition, there is no case in which the liquid ejected from the recording head 29 is stuck to the intermediate portions 38*b* and 39*b* of the sheet metal members 38 and 39.

The maintenance sheet 14 is supported such that the inner surface of a front end portion in the movement direction of the sheet material 14A having an endless shape is bonded to the intermediate portion 38*b* of the first sheet metal member 38 on the front side in the transport direction X, and the inner surface of the sheet material 14A is not bonded to the intermediate portion 39*b* of the second sheet metal member 39 on the back side in the transport direction X. That is, the maintenance sheet 14 is supported such that the front end portion in the movement direction thereof is fixed to the first sheet metal member 38 on the front side so as to be positioned and supported in the circular movement direction, and a portion on the back side from the front end portion in the movement direction thereof is slidable in the circular movement direction with respect to the second sheet metal member 39 on the back side.

At a substantially central portion in the transport direction X of an ink receiving surface (liquid receiving surface) 14*b* opposite the nozzle forming surface 29*a* on a surface of the maintenance sheet 14 on an outer circumferential side (in FIG. 5, an upper side) during the circular movement, an ink receiving area (liquid receiving area) 40 is set to have a slender rectangular shape in the left-right direction inside an edge portion of the ink receiving surface 14*b*. With the ink receiving area 40, the maintenance sheet 14 is flexible. Therefore, the ink receiving area 40 is slightly bent to the inner circumferential side from the edge portions of both the front and back ends (portions corresponding to the intermediate portions 38*b* and 39*b* of the sheet metal members 38 and 39) (see FIG. 5). A control device 41 (see FIG. 10) serving as a control unit controls the movement velocity of the chains 37 transporting the maintenance sheet 14 and the ink ejection timing from the recording head 29, such that waste ink ejected from the recording head 29 toward the maintenance sheet 14 is received in the ink receiving area 40.

As shown in FIGS. 1, 3, and 4, an optical sensor (detection unit) 42 is provided at a position on a back side in the transport direction X of the sheet 12 from the recording head 29 and above the right-side second support plate 22. The optical sensor 42 is formed by a light-emitting and light-receiving sensor that emits light toward the upper end surface of the second support plate 22, and when light is reflected by the upper end surface of the second support plate 22, receives reflected light. When both end portions 38*a* and 39*a* of the sheet metal members 38 and 39 provided between the left and right chains 37 pass below the optical sensor 42 and light is blocked, a detection signal indicating that the sheet metal members 38 and 39 supporting the maintenance sheet 14 pass through a position where the optical sensor 42 is provided is output to the control device 41.

As shown in FIG. 5, when being stretched between both the sheet metal members 38 and 39, a surface on the inner circumferential side (in FIG. 5, the lower side) of the maintenance sheet 14 becomes a brush surface (a cleaning function surface) 43 with a plurality of fabrics in a brush shape. As shown in FIG. 1, when the maintenance sheet 14 stops at a standby position P corresponding to the tension pulley 20 on the back side in the sheet transport mechanism 13 on the circular path of the chains 37, the brush surface 43 comes into slide contact with the surface 23*a* of the transport belt 23 wound around the tension pulley 20 so as to wipe the surface 23*a* of the transport belt 23. That is, the brush surface 43 of the maintenance sheet 14 slides with a difference in velocity with respect to the surface 23*a* of the transport belt 23, which circularly moves, so as to have a cleaning function to wipe the surface 23*a* of the transport belt 23.

As shown in FIGS. 1, and 6 to 8, a pair of front and back guide plates (guide units) 44 and 45 are provided at positions corresponding to the driven sprockets 33 and 34 on the front and back sides of the sheet transport mechanism 15 and between both the left and right chains 37. The guide plates 44 and 45 are made of a metallic plate material, and have sectional shapes following the arc-shaped curved path portions of the chains 37, which are meshed with the driven sprockets 33 and 34, respectively. That is, the inner circumferential surfaces (engagement portions) 44*a* and 45*a* of the respective guide plates 44 and 45 have concave curved shapes along the path direction of the arc-shaped curved path portions of the chains 37. Though not shown, the guide plates 44 and 45 are supported by brackets with respect to the main body frame of the printer 11.

Figure 6:
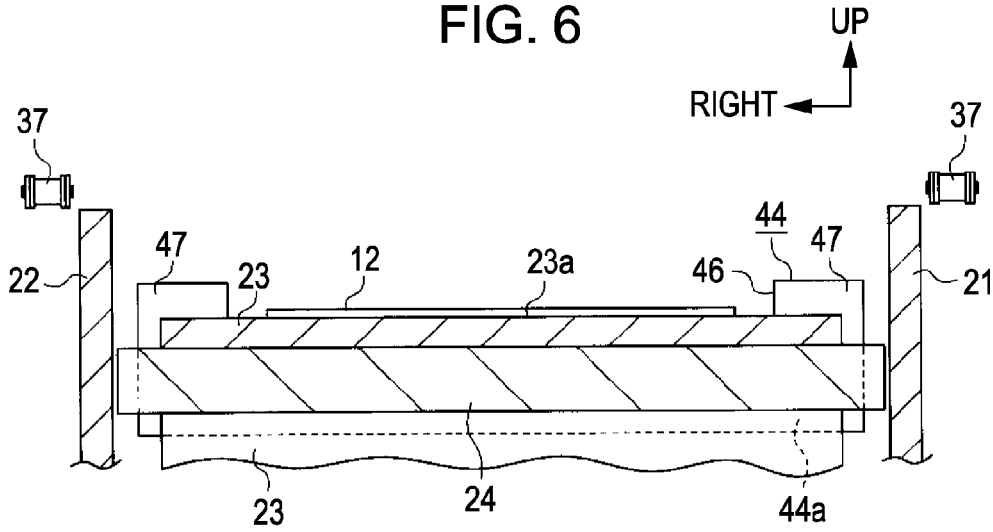
FIG. 6 is a sectional view taken along the line VI-VI of FIG. 1.
Figure 7:
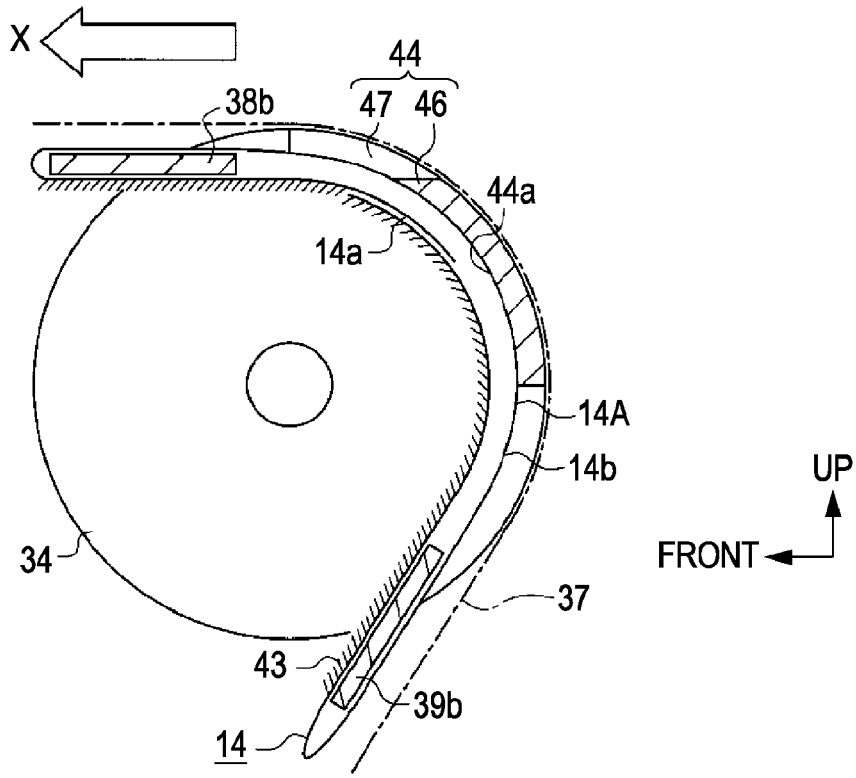
FIG. 7 is a schematic sectional view showing an upstream-side curved path portion in a circular path of a chain.

As shown in FIGS. 6 and 7, the upstream-side guide plate 44 corresponding to the back-side driven sprocket 34 is formed of a single rigid plate member having a substantially rectangular shape. A cutout portion (target passing portion) 46 is formed from an upper edge of the plate member to have an opening width larger than the width of the sheet 12 in the left-right direction and shorter than the length in the left-right direction of each of the intermediate portions 38*b* and 39*b* of the sheet metal members 38 and 39. The cutout portion 46 is provided in order to permit passing of the sheet 12 fed from the sheet feed tray onto the transport belt 23. A pair of left and right protrusion pieces 47 are formed on the left and right sides of the cutout portion 46.

When the sheet metal members 38 and 39 supporting the maintenance sheet 14 pass through the arc-shaped curved path portion along the outer circumference of the driven sprocket 34 during the circular movement, the intermediate portions 38*b* and 39*b* of the sheet metal members 38 and 39 are engaged with the inner circumferential surface 44*a* of the upstream-side guide plate 44 through the sheet material 14A so as to be guided in the movement direction. While the sheet metal members 38 and 39 and the maintenance sheet 14, which is supported in the stretched state by the sheet metal members 38 and 39, tends to be deformed outward due to a centrifugal force when passing through the arc-shaped curved path portion, with the inter circumferential surface 44*a* of the upstream-side guide plate 44, the sheet metal members 38 and 39 and the maintenance sheet 14 are prevented from being deformed outward.

Figure 8:
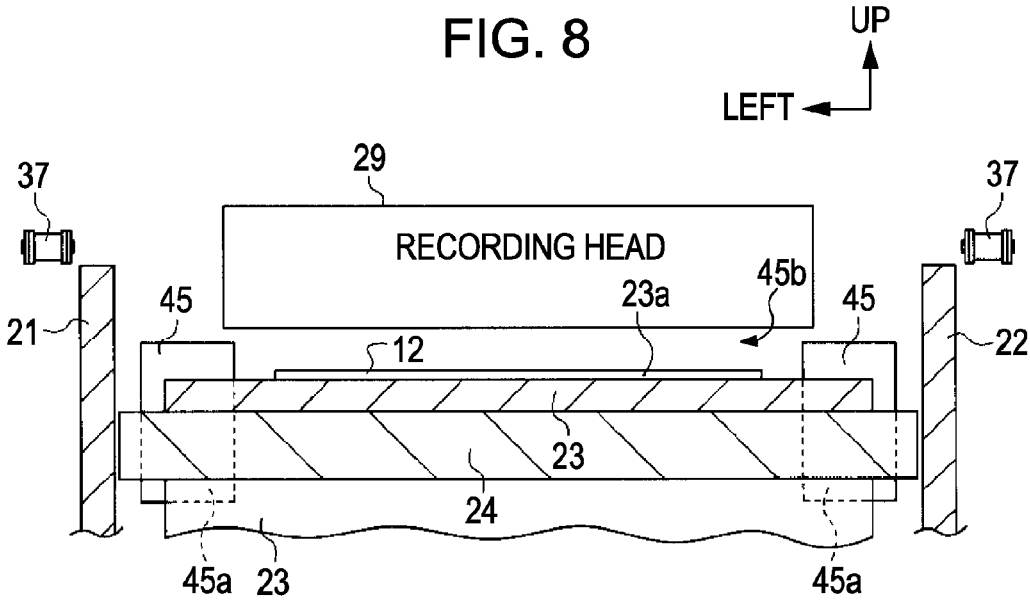
FIG. 8 is a sectional view taken along the line VIII-VIII of FIG. 1.

As shown in FIGS. 4 and 8, the downstream-side guide plates 45 corresponding to the front-side driven sprocket 33 have two rigid plate pieces having a substantially rectangular shape and the same width in the left-right direction as that of each of the protrusion pieces 47 of the upstream-side guide plate 44. The two downstream-side guide plates 45 are disposed to be spaced from each other such that a distance between opposing inter edges in the left-right direction thereof becomes identical to the opening width of the cutout portion 46 in the upstream-side guide plate 44. For this reason, the sheet 12 that is discharged from the transport belt 23 toward the sheet discharge tray can pass through a space area 45*b* between both the left and right downstream-side guide plates 45. From this viewpoint, the space area 45*b* between inner edges of both the downstream-side guide plates 45 functions as a target passing portion. When the sheet metal members 38 and 39 supporting the maintenance sheet 14 pass through the arc-shaped curved path portion along the outer circumference of the driven sprocket 33 during the circular movement, the intermediate portions 38*b* and 39*b* of the sheet metal members 38 and 39 are engaged with the inner circumferential surfaces 45*a* of both the guide plates 45 through the sheet material 14A so as to be guided in the movement direction.

As shown in FIG. 1, a cleaning mechanism (cleaning unit) 48 is provided at a downwardly sloping position in front of the front-side tension pulley 19 in the sheet transport mechanism 13 (a cleaning position on a downstream side from a position opposite the nozzle forming surface 29*a*) outside the circular path of the chains 37 in the sheet transport mechanism 15. As shown in FIGS. 9A to 9D, the cleaning mechanism 48 includes a cleaning roller (cleaning member) 50 that rotates and is displaced around an axis parallel to the axis of the tension pulley 19 on the basis of a driving force of a cleaning motor 49 (see FIG. 10) which functions as a switching unit and a rotation driving unit. The cleaning roller 50 is formed such that at least a portion on a circumferential surface thereof is formed of a liquid-absorbent material and a section thereof perpendicular to the axis has a shape of alphabet letter "D".

In other words, the cleaning roller 50 has an arc portion 51 having a cylindrical circumferential surface and a planar chord portion 52. That is, in the cleaning roller 50, a distance L1 between a shaft portion 50*a* and the circumferential surface of the arc portion 51 is set so as to be longer than a distance L2 between the shaft portion 50*a* and the circumferential surface of the chord portion 52. A difference between the distance L1 and the distance L2 is set so as to be larger than the total thickness L3 of the thickness of each of the intermediate portions 38*b* and 39*b* of the sheet metal members 38 and 39 in the sheet transport mechanism 15 and the thickness corresponding to two sheets of the sheet material 14A constituting the maintenance sheet 14 (that is, the condition L1-L2>L3 is satisfied).

Figure 9B:
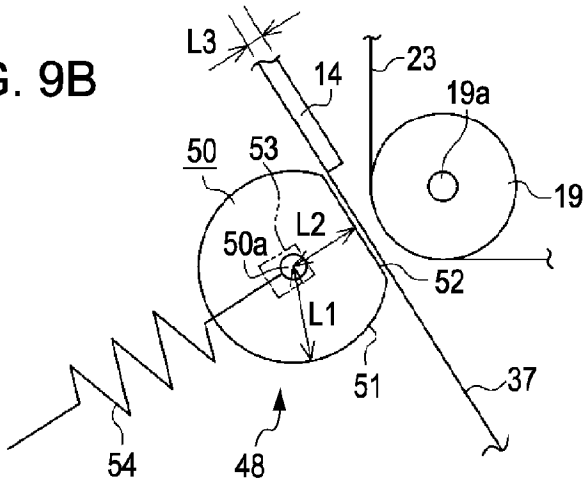
FIG. 9B is a schematic view before cleaning of a maintenance sheet starts.

The cleaning roller 50 is supported by inserting the shaft portion 50*a* into a long groove 53, which is formed in the bracket of the main body frame (not shown). The long groove 53 is formed in the bracket of the main body frame (not shown) such that the longitudinal direction thereof extends along a line connecting the shaft portion 50*a* of the cleaning roller 50 and the shaft portion 19*a* of the tension pulley 19. A spring member (urging unit) 54 is provided such that a base end thereof is supported by the bracket of the main body frame, and a front end thereof is attached to the shaft portion 50*a* of the cleaning roller 50. The spring member 54 is configured to be compressed in the longitudinal direction of the long groove 53. As shown in FIGS. 9A and 9B, in a normal state, the cleaning roller 50 is held by the spring member 54 being in an uncompressed state such that the shaft portion 50*a* thereof stands still at a first position in the long groove 53 closest to the tension pulley 19.

In the normal state, as shown in FIG. 9A, when the cleaning roller 50 is turned in a cleaning posture in which the arc portion 51 faces the tension pulley 19, the shaft portion 50*a* is located at the first position of the long groove 53, and the circumferential surface of the arc portion 51 comes into contact with the surface 23*a* of the transport belt 23, which is wound around the tension pulley 19. That is, the circumferential surface of the arc portion 51 of the cleaning roller 50 comes into slide contact with the surface 23*a* of the transport belt 23 that is circularly moving, thereby wiping the surface 23*a* of the transport belt 23. In this case, the transport belt 23 is sandwiched between the tension pulley 19 and the arc portion 51 of the cleaning roller 50 functioning as sandwich members.

In the normal state, as shown in FIG. 9B, when the cleaning roller 50 is turned in a non-cleaning posture in which the chord portion 52 faces the tension pulley 19, even if the shaft portion 50*a* is located at the first position in the long groove 53, the circumferential surface of the chord portion 52 does not come into contact with the surface 23*a* of the transport belt 23, which is wound around the tension pulley 19. In this state, the planar circumferential surface of the chord portion 52 does not come into contact with the maintenance sheet 14, which moves by circular movement of the chains 37. From this point, the chord portion 52 in the cleaning roller 50 whose circumferential surface cannot come into contact with the maintenance sheet 14 functions as a non-cleaning function portion.

Figure 9D:
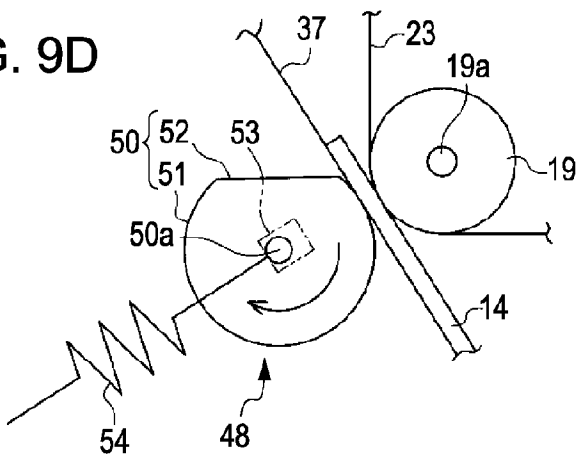
FIG. 9D is a schematic view showing when cleaning of a maintenance sheet ends.
Figure 9A:
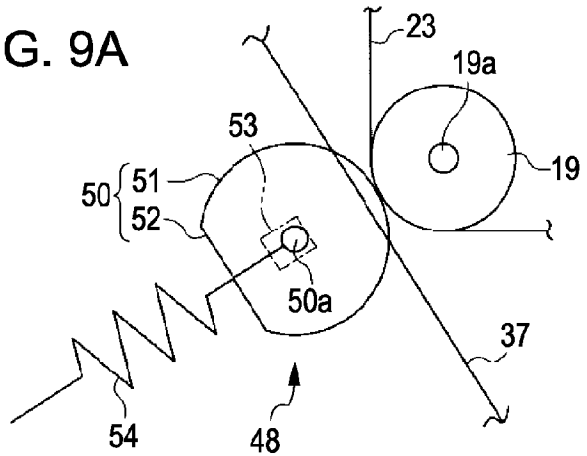
FIG. 9A is a schematic view showing when cleaning of a transport belt is performed.
Figure 9C:
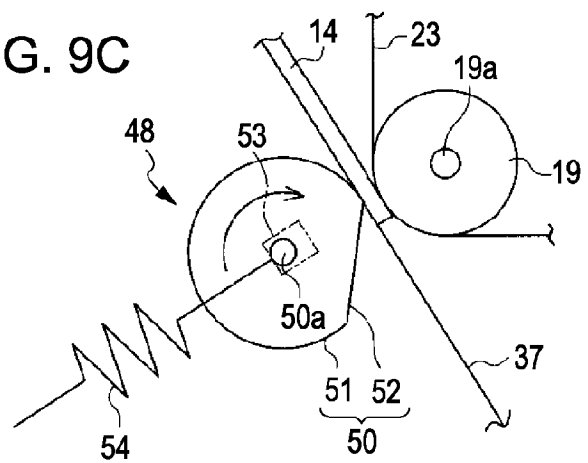
FIG. 9C is a schematic view showing when cleaning of a maintenance sheet starts.

As shown in FIGS. 9C and 9D, when the cleaning roller 50 is turned in the cleaning posture in which the arc portion 51 faces the tension pulley 19, if the maintenance sheet 14 is transported between the arc portion 51 and the tension pulley 19, the cleaning roller 50 comes into contact with the ink receiving surface 14*b* on the outer circumferential side of the maintenance sheet 14. That is, if the cleaning roller 50 comes into contact with the maintenance sheet 14, the shaft portion 50*a* moves to a second position away from the tension pulley 19 in the long groove 53 while compressing the spring member 54, and the circumferential surface of the arc portion 51 comes into contact with the surface on the outer circumferential side of the maintenance sheet 14 that is circularly moving, thereby wiping a surface of the maintenance sheet 14 to which ink is stuck. From this viewpoint, the arc portion 51 in the cleaning roller 50 whose circumferential surface can come into contact with the maintenance sheet 14 functions as a cleaning function portion. In this case, the maintenance sheet 14 is sandwiched between the tension pulley 19 and the arc portion 51 of the cleaning roller 50, which function as sandwich members, by an urging force of the compressed spring member 54.

Next, the control configuration in the printer 11 will be described with reference to FIG. 10.

Figure 10:
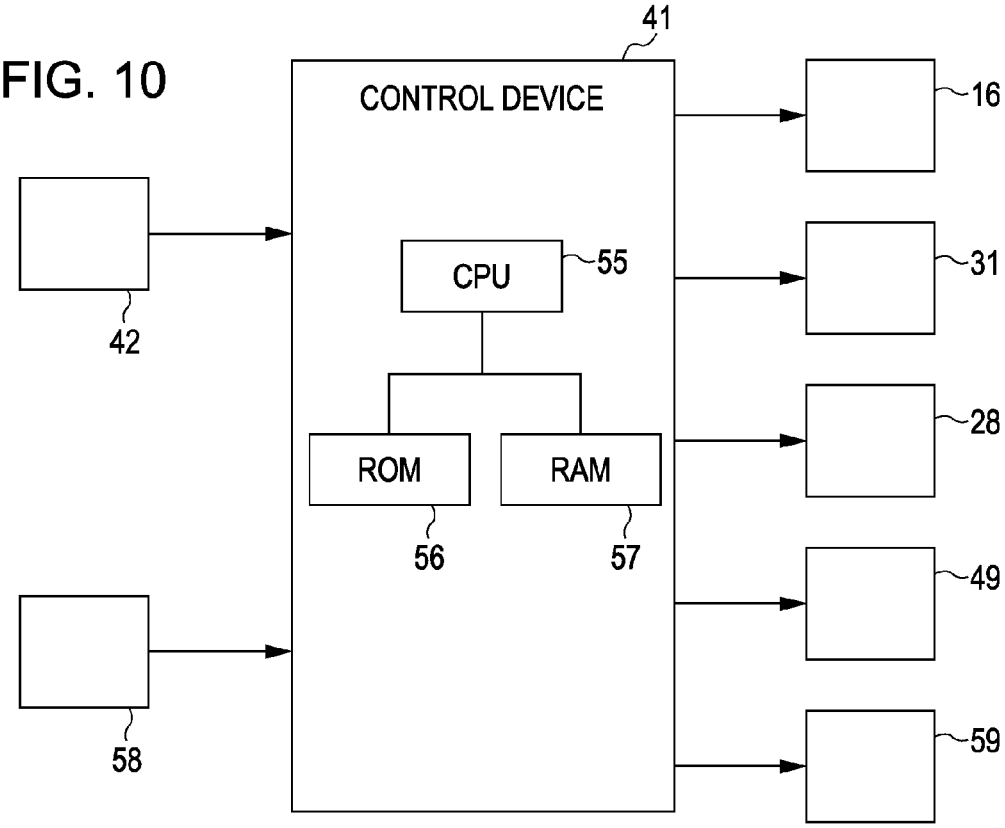
FIG. 10 is a block diagram of a control device.

As shown in FIG. 10, the control device (control unit) 41 that overall controls the operation state of the printer 11 has a digital computer, which includes an input-side interface (not shown), an output-side interface (not shown) a CPU 55, a ROM 56, a RAM 57, and the like, as a main constituent element. The optical sensor 42 and a touch-input type operation panel (input unit) 58 provided at the surface of the main body frame of the printer 11 are electrically connected to the input-side interface. A piezoelectric element 59, which is driven when ink is ejected from the recording head 29, the sheet transport motor 16, a fan 28, the sheet transport motor 31, and the cleaning motor 49 are electrically connected to the output-side interface.

In the control device 41, the ROM 56 stores a control program for controlling the respective mechanisms (the piezoelectric element 59, the sheet transport motor 16, and the like). The RAM 57 stores various kinds of information (the detection signal of the optical sensor 42 and the like) which are appropriately rewritten while the printer 11 is being driven. The control device 41 individually controls the mechanisms on the output side (the piezoelectric element 59, the sheet transport motor 16, and the like) on the basis of signals from the optical sensor 42 and the operation panel 58 on the input side.

As shown in FIG. 1, a plurality of path portions Z1 to Z3 are set on the circular path of the chains 37, which circularly move in order to transport the maintenance sheet 14, in the sheet transport mechanism 15 for different purposes of movement of the maintenance sheet 14 along the path.

First, a path portion that is located on a downstream side in the circular movement direction of the chains 37 from the standby position P, at which the maintenance sheet 14 faces the tension pulley 20 with the transport belt 23 sandwiched therebetween, and between both the front and back driven sprockets 33 and 34 is the first path portion Z1 including a position opposite the nozzle forming surface 29*a*. At the first path portion Z1, the maintenance sheet 14 is interruptively disposed between a previous sheet 12 and a subsequent sheet 12, which are sequentially fed onto the transport belt 23 (see FIG. 3). In this state, the maintenance sheet 14 is absorbed onto the surface 23*a* of the transport belt 23 by negative pressure and is transported in the transport direction X so as to pass through the position opposite the nozzle forming surface 29*a* of the recording head 29. That is, at the first path portion Z1, waste ink ejected (discharged) from the recording head 29 for flushing is received by the maintenance sheet 14 that passes through the position opposite the nozzle forming surface 29*a*.

Next, the second path portion Z2 for cleaning the maintenance sheet 14 by the cleaning mechanism 48 is set between the front-side driven sprocket 33 and the lower driving sprocket 32 on the circular path of the chains 37 so as to be spaced at a predetermined interval from the first path portion Z1. The second path portion Z2 is set to have a length including at least an area where the maintenance sheet 14 moves from when the maintenance sheet 14 starts to come into contact with the arc portion 51 of the cleaning roller 50 (FIG. 9C) until the maintenance sheet 14 comes into contact with the arc portion 51 of the cleaning roller 50 (FIG. 9D).

The third path portion Z3 is set between the second path portion Z2 and the standby position P on the circular path of the chains 37 so as to return the maintenance sheet 14 having cleaned at the second path portion Z2 to the standby position P for reuse. That is, with circular movement of the chains 37, the maintenance sheet 14 returns from the standby position P to the standby position P through the first path portion Z1, the second path portion Z2, and the third path portion Z3 in that order. The maintenance sheet 14 waits at the standby position P in a standstill state until next flushing is performed.

Next, the action of the printer 11 of this embodiment having the above-described configuration will be described, focusing on flushing during printing.

When the printer 11 performs printing on the sheet 12, the sheet 12 is sequentially fed from the sheet feed tray (not shown) onto the transport belt 23 at a predetermined interval. In this case, as shown in FIG. 6, the sheet 12 passes through the cutout portion (target passing portion) 46 of the upstream-side guide plate 44 and is fed onto the transport belt 23. Simultaneously, the control device 41 operates the sheet transport motor 16 and the fan 28, such that the transport belt 23 transports the sheet 12 to the downstream side in the transport direction X while the sheet 12 is absorbed onto the surface 23*a* (transport plane) by negative pressure.

At the moment the sheet 12 passes through the position opposite the nozzle forming surface 29*a* of the recording head 29, the control device 41 drives the piezoelectric element 59 in the recording head 29. As a result, ink for printing is ejected from the nozzles 30 of the recording head 29 onto the surface of the sheet 12. The sheet 12, on which printing is performed by ink ejection from the recording head 29, is further transported to the downstream side in the transport direction X by circular movement of the transport belt 23. Thereafter, as shown in FIG. 8, the sheet 12 passes through the space area (target passing portion) 45*b* between the inner edges of both the left and right downstream-side guide plates 45 and is discharged to the sheet discharge tray.

During printing, as shown in FIG. 9A, the cleaning mechanism 48 is in the normal state in which the circumferential surface of the arc portion 51 in the cleaning roller 50 faces the circumferential surface of the tension pulley 19 with the transport belt 23 sandwiched therebetween and comes into contact with the surface 23*a* of the transport belt 23. Accordingly, when a belt portion of the transport belt 23 on a downstream side in the circular movement direction from the driving pulley 17 after the sheet 12 is transported while being absorbed passes through the circumferential surface of the tension pulley 19 by circular movement, the surface 23*a* of the transport belt 23 comes into slide contact with the circumferential surface of the liquid-absorbent arc portion 51 of the cleaning roller 50. For this reason, when ink is stuck to the surface 23*a* of the transport belt 23, stuck ink is wiped by the cleaning roller 50 on the circular path.

In this case, in the sheet transport mechanism 15, in a state where the maintenance sheet 14 is located at the standby position P, the sheet transport motor 31 is controlled in a driving stop state by the control device 41. For this reason, as shown in FIG. 1, if paper dust or particles are stuck to the surface 23*a* of the transport belt 23, which circularly moves, they are wiped by the brush surface 43 of the maintenance sheet 14 that stops at the standby position P. That is, after the surface 23*a* is wiped by the arc portion 51 of the cleaning roller 50 and the brush surface 43 of the maintenance sheet 14 in the above-described manner, the transport belt 23 of the sheet transport mechanism 13 places a subsequent sheet 12 on the cleaned surface 23*a* and transports the sheet 12 in the transport direction X.

In the printer 11, during flushing in which waste ink is ejected from the nozzles 30 of the recording head 29 and discharged when printing is not performed, the sheet transport mechanism 15 is driven by the control device 41 as follows. That is, when an instruction signal to execute manual flushing based on a user's input operation is input from the operation panel 58 or when it is determined that a scheduled flushing condition is satisfied, the control device 41 drives the sheet transport motor 31 to start circular movement of the chain 37. In this embodiment, the control device 41 satisfies the scheduled flushing condition when ten sheets 12 are successively printed.

If the sheet transport motor 31 is driven, the chain 37 starts to circularly move. With the circular movement, as shown in FIG. 7, the maintenance sheet 14 supported by the sheet metal members 38 and 39 moves so as to follow the arc-shaped movement trajectory from the standby position P along the outer circumference of the back-side driven sprocket 34 and is transported to the first path portion Z1. When the maintenance sheet 14 moves along the outer circumference of the driven sprocket 34, the intermediate portions 38*b* and 39*b* of the front and back sheet metal members 38 and 39 come into slide contact with the inner circumferential surface 44*a* having an arc-shaped sectional shape of the upstream-side guide plate 44 through the maintenance sheet 14. In this way, the intermediate portions 38*b* and 39*b* are guided in the movement direction.

When the sheet metal members 38 and 39 pass through the arc-shaped curved path portion along the outer circumference of the driven sprocket 34, the movement velocity of the intermediate portions 38*b* and 39*b* on the inner circumferential side supporting the maintenance sheet 14 becomes slower than the movement velocity of both end portions 38*a* and 39*a* on the outer circumferential side connected to the chains 37 due to the an inner wheel difference. That is, the intermediate portions 38*b* and 39*b* of both the front and back sheet metal members 38 and 39 have a difference in velocity when one of them is passing through the curved path portion and the other one is passing through the linear path portion.

For this reason, in a state where the front sheet metal member 38 has already entered the curved path portion, and the back sheet metal member 39 does not enter the curved path portion yet and is passing through the linear path portion, the intermediate portion 39*b* of the sheet metal member 39 moves forward in the circular movement direction so as to reduce the interval from the intermediate portion 38*b* of the front sheet metal member 38. In this case, since the intermediate portion 39*b* of the back sheet metal member 39 is supported slidably while being not bonded to the sheet material 14A of the maintenance sheet 14, the forward movement in the circular movement direction is permitted. For this reason, there is no case in which the maintenance sheet 14 supported in a stretched state between the intermediate portions 38*b* and 39*b* of both the sheet metal members 38 and 39 is bent by distortion or undergoes a useless tensile force.

In a state where the front sheet metal member 38 has already passed through the curved path portion and is passing through the linear path portion, and the back sheet metal member 39 is still passing through the curved path portion, the intermediate portion 39*b* of the back sheet metal member 39 moves backward in the circular movement direction so as to widen the interval from the intermediate portion 38*b* of the front sheet metal member 38. In this case, since the intermediate portion 39*b* of the back sheet metal member 39 is supported slidably while being not bonded to the sheet material 14A of the maintenance sheet 14, the backward movement in the circular movement direction is permitted. For this reason, there is no case in which the maintenance sheet 14, which is supported in a stretched state between the intermediate portions 38*b* and 39*b* of both the sheet metal members 38 and 39, is bent by distortion or undergoes a useless tensile force.

The maintenance sheet 14, which is supported in a stretched state between the intermediate portions 38*b* and 39*b* of both the sheet metal members 38 and 39, tends to be deformed outward due to a centrifugal force when moving to follow the arc-shaped movement trajectory. In this case, however, the sheet portion of the maintenance sheet 14, which tends to be deformed outward, comes into slide contact with a central area of the inner circumferential surface 44*a* of the upstream-side guide plate 44 (an area below the cutout portion 46). For this reason, the maintenance sheet 14, which is supported in a stretched state between the intermediate portions 38*b* and 39*b* of the sheet metal members 38 and 39, is prevented from being deformed and largely swollen outward when moving to follow the arc-shaped movement trajectory along the outer circumference of the driven sprocket 34, and is transported to the first path portion Z1 in a stable stretched state. Therefore, the maintenance sheet 14 is absorbed and held so as to appropriately come into surface contact with the surface 23*a* of the transport belt 23 at the first path portion Z1.

When the maintenance sheet 14 that has stopped at the standby position P is transported to the first path portion Z1 in connection with circular movement of the chains 37 when the sheet transport motor 31 starts to be driven, as shown in FIG. 3, the maintenance sheet 14 is transported so as to be interruptively disposed at an intermediate position between the previous sheet 12 and the subsequent sheet 12 at regular intervals in the front-back direction on the transport belt 23. In this case, the control device 41 controls the driving start timing of the sheet transport motor 31 on the basis of the movement distance of the maintenance sheet 14 from the standby position P to an upstream end of the first path portion Z1, the movement velocity of the chains 37 at that time, and a feed interval between the previous sheet 12 and the subsequent sheet 12 onto the transport belt 23 in the sheet transport mechanism 13.

At the first path portion Z1, the control device 41 controls the driving states of the sheet transport motor 31 and the sheet transport motor 16 such that the circular movement velocity of the chains 37 to transport the maintenance sheet 14 in the transport direction X becomes identical (first velocity) to the circular movement velocity of the transport belt 23. For this reason, the maintenance sheet 14 is planarly absorbed onto the surface 23*a* of the transport belt 23 by negative pressure when the fan 28 is driven and transported in the transport direction X while maintaining the same interval in the transport direction X with respect to the previous sheet 12 on the front side and the subsequent sheet 12 on the back side. The maintenance sheet 14 passes through the position opposite the nozzle forming surface 29*a* of the recording head 29 with timing different from timing when the sheet 12 passes through the position opposite the nozzle forming surface 29*a* of the recording head 29.

In this case, the chains 37 and both end portions 38*a* and 39*a* connected to the connection pieces 37*a* of the chains 37 in the sheet metal members 38 and 39 move positions above both the left and right support plates 21 and 22 in the sheet transport mechanism 13 along the transport direction X, respectively. For this reason, it is not necessary to secure movement spaces of the chains 37 or the like on the left and right sides of the transport belt 23 so as to be aligned with the surface 23*a* of the transport belt 23, and as a result, a degree of freedom for design in the printer 11 is almost not limited.

Thereafter, if the right end portion 38*a* of both end portions 38*a* of the front sheet metal member 38 moves below the position where the optical sensor 42 is provided, light emitted from and received by the optical sensor 42 is blocked, and the detection signal is output from the optical sensor 42 to the control device 41. When this happens, the control device 41 calculates a time required until the ink receiving area 40 of the maintenance sheet 14 is located at the position opposite the nozzle forming surface 29*a*, on the basis the movement velocity of the chains 37 at that time and a distance from the position (reference position) where the optical sensor 42 is provided to a position below the recording head 29 (the position opposite the nozzle forming surface 29*a*).

The control device 41 drives the piezoelectric element 59 in the recording head 29 when the calculated time has elapsed. When this happens, waste ink for flushing is ejected (discharged) from the nozzles 30 of the recording head 29 and received by the ink receiving area 40 set at the central portion of the outer circumferential surface of the maintenance sheet 14. In this case, ink is ejected from the nozzles 30 formed at the nozzle forming surface 29*a* of the recording head 29 in an order of from the nozzles 30 of the nozzle column on the upstream side in the transport direction X to the nozzles 30 of the nozzle column on the downstream side when the ink receiving area 40 of the maintenance sheet 14 passes through in the transport direction X.

As described above, the maintenance sheet 14 that has received waste ink ejected from the nozzles 30 when moving the position below the nozzle forming surface 29*a* of the recording head 29 at the first path portion Z1 next moves so as to follow the arc-shaped movement trajectory along the outer circumference of the front driven sprocket 33 and is transported to the second path portion Z2. When the maintenance sheet 14 moves along the outer circumference of the driven sprocket 33, like when being guided by the upstream-side guide plate 44 on the back side, the intermediate portions 38*b* and 39*b* of the front and back sheet metal members 38 and 39 come into slide contact with the inner circumferential surfaces 45*a* having an arc-shaped sectional shape of the downstream-side guide plates 45 through the maintenance sheet 14. As a result, the intermediate portions 38*b* and 39*b* are guided in the movement direction.

In this case, the intermediate portions 38*b* and 39*b* of both the front and back sheet metal members 38 and 39 have a difference in velocity due to the inner wheel difference from both end portions 38*a* and 39*a* on the outer circumferential side and approach each other or are separated from each other, like when passing through the arc-shaped curved path portion along the outer circumference of the driven sprocket 34 on the back side. In this case, however, since the intermediate portion 39*b* of the back sheet metal member 39 is supported slidably while being not bonded to the sheet material 14A of the maintenance sheet 14, the approach and separation movements in the circular movement direction are permitted. For this reason, there is no case in which the maintenance sheet 14, which is supported in a stretched state between the intermediate portions 38*b* and 39*b* of both the sheet metal members 38 and 39, is bent by distortion or undergoes a useless tensile force.

When the maintenance sheet 14, which is supported in a stretched state between the intermediate portions 38*b* and 39*b* of both the sheet metal members 38 and 39, moves so as to follow the arc-shaped movement trajectory, the ink receiving area 40 that has received waste ink ejected from the recording head 29 moves the space area 45*b* between the inner edges of both the left and right downstream-side guide plates 45. For this reason, there is no case in which the downstream-side guide plates 45 are contaminated due to waste ink stuck to the ink receiving area 40 of the maintenance sheet 14.

If the maintenance sheet 14 enters the arc-shaped curved path portion along the outer circumference of the driven sprocket 33 on the front side, the cleaning motor 49 is driven to rotate by the control device 41. When this happens, in the cleaning mechanism 48, the cleaning roller 50 rotates by 180° from the cleaning posture of FIG. 9A to the non-cleaning posture of FIG. 9B. In this state, the control device 41 stops the rotation of the cleaning motor 49, the cleaning mechanism 48 waits for until the front end portion in the movement direction of the maintenance sheet 14 enters the second path portion Z2, while being in the non-cleaning posture of FIG. 9B.

Next, as shown in FIG. 9C, if the front end portion of the maintenance sheet 14 enters the second path portion Z2 by circular movement of the chains 37, the control device 41 restarts the rotation of the cleaning motor 49. When this happens, the cleaning roller 50 rotates in a clockwise direction indicated by arrows of FIGS. 9C and 9D and is switched to the cleaning posture, and the circumferential surface of the arc portion 51 comes into rolling contact with the outer circumferential surface of the maintenance sheet 14 (a surface having the ink receiving area 40). Thereafter, if the maintenance sheet 14 moves to the downstream side in the circular movement direction and is turned in the state of FIG. 9D, in the cleaning roller 50, the circumferential surface of the arc portion 51 is separated from the outer circumferential surface of the maintenance sheet 14.

The control device 41 controls the driving state of the sheet transport motor 31 such that, while the maintenance sheet 14 is passing through the second path portion Z2 (that is, is switched from the state of FIG. 9C to the state of FIG. 9D), the circular movement velocity of the chains 37 becomes slower (second velocity) than the velocity at the first path portion Z1 (that is, the first velocity identical to the circular movement velocity of the transport belt 23). If the maintenance sheet 14 moves slowly, waste ink received by the ink receiving area 40 of the maintenance sheet 14 during flushing is reliably absorbed and wiped by the liquid-absorbent arc portion 51 while the cleaning roller 50 rotates approximately once.

In this case, an area with which the arc portion 51 of the cleaning roller 50 comes into rolling contact is a central area 60 (see FIG. 3), excluding the edge portions at both the front and back ends, on the entire ink receiving surface 14*b* on the outer circumferential side of the maintenance sheet 14. That is, the control device 41 controls the rotation velocity of the cleaning roller 50 by driving the cleaning motor 49 such that the arc portion 51 of the cleaning roller 50 comes into rolling contact with only the central area 60 of the maintenance sheet 14. For this reason, when the circumferential surface of the arc portion 51 of the cleaning roller 50 comes into rolling contact with the liquid-repellant maintenance sheet 14, there is no case in which waste ink is pushed out of the ink receiving area 40 by the arc portion 51 of the cleaning roller 50 and flows out of the edge portions of the maintenance sheet 14. In addition, there is no case in which the arc portion 51 of the cleaning roller 50 comes into contact with the edge portions of the maintenance sheet 14 having a reinforced shape by contact of the intermediate portions 38*b* and 39*b* of the sheet metal members 38 and 39. Therefore, the lifespan of the cleaning roller 50 can be extended.

With circular movement of the chains 37, the maintenance sheet 14 with waste ink wiped from the ink receiving area 40 at the second path portion Z2 is transported to the standby position P through the third path portion Z3 for next flushing. After the maintenance sheet 14 has passed through, at the second path portion Z2, the control device 41 stops the rotation of the cleaning motor 49 when the cleaning roller 50 is turned in the state of FIG. 9A. As a result, the circumferential surface of the arc portion 51 of the cleaning roller 50 comes into slide contact with the surface 23*a* of the transport belt 23 again, thereby wiping the surface 23*a* of the transport belt 23.

When the maintenance sheet 14 moves the third path portion Z3 toward the standby position P, the control device 41 controls the driving state of the sheet transport motor 31 such that the circular movement velocity of the chains 37 becomes faster (third velocity) than the velocity at the first path portion Z1 (that is, the first velocity identical to the circular movement velocity of the transport belt 23). For this reason, the maintenance sheet 14, which has been cleaned with waste ink wiped at the second path portion Z2, is rapidly transported to the standby position P. When flushing is performed again, the sheet transport mechanism 15 is driven again in the same procedure as described above.

According to the above-described embodiment, the following effects can be obtained.

(1) During flushing in which waste ink is ejected from the nozzles 30 of the recording head 29, the intermediate portions 38*b* and 39*b* of the sheet metal members 38 and 39 in the sheet transport mechanism 15 move the space areas on the surface 23*a* side of the transport belt 23 when viewed from the nozzle forming surface 29*a* along the surface 23*a* of the transport belt 23 serving as the transport path of the sheet 12 with movement of the chains 37. For this reason, the maintenance sheet 14, which is supported in a stretched state between the intermediate portions 38*b* and 39*b* of the sheet metal members 38 and 39, passes through between the surface 23*a* of the transport belt 23 and the nozzle forming surface 29*a* so as to be opposite the nozzle forming surface 29*a*, and receives waste ink ejected from the nozzles 30 at that time. In this case, the chains 37, to which the sheet metal members 38 and 39 are connected, move the space areas on a side opposite to the surface 23*a* of the transport belt 23 when viewed from the nozzle forming surface 29*a*. For this reason, in this printer 11, it is not necessary to secure the movement spaces of the chains 37 so as to be aligned with the surface 23*a* of the transport belt 23. Therefore, even if the chains 37 are used to transport the maintenance sheet 14 for receiving waste ink ejected from the recording head 29 during flushing to the position opposite the nozzle forming surface 29*a* of the recording head 29, a degree of freedom for design of the printer 11 can be prevented from being limited.

(2) In the sheet transport mechanism 15, the sheet metal members 38 and 39, which support the maintenance sheet 14, and the chains 37, which are moving with the sheet metal members 38 and 39 connected thereto, have rigidity. The sheet metal members 38 and 39 are bent between the end portions 38*a* and 39*a* serving as connection portions to the chains 37 and the intermediate portions 38*b* and 39*b*, which support the maintenance sheet 14. For this reason, a degree of freedom for design of the printer 11 can be secured, and the maintenance sheet 14 can be transported in a stable posture to the position opposite the nozzle forming surface 29*a* of the recording head 29.

(3) The sheet material 14A constituting the maintenance sheet 14 is configured such that the front end portion in the movement direction is fixed to the intermediate portions 38*b* and 39*b* of the sheet metal members 38 and 39 connected to the chains 37. For this reason, a portion on the back side from the front end portion in the movement direction follows movement of the sheet metal members 38 and 39, which move integrally with the chains 37, and is stretched backward in the movement direction chain 37. Therefore, the maintenance sheet 14 is located at the position opposite the nozzle forming surface 29*a* of the recording head 29 in such a stretched state. As a result, the maintenance sheet 14 can reliably receive ink that is ejected from the recording head 29 as waste ink.

(4) When both the front and back sheet metal members 38 and 39 in the sheet transport mechanism 15 pass through the arc-shaped curved path portion with movement of the chains 37, a difference in velocity occurs between the intermediate portion 38*b* of the front sheet metal member 38 and the intermediate portion 39*b* of the back sheet metal member 39 due to an inner wheel difference. Accordingly, both the intermediate portions 38*b* and 39*b* relatively move so as to approach each other or be separated from each other. In this case, if the sheet material 14A constituting the maintenance sheet 14 is fixed to the intermediate portions 38*b* and 39*b* of the sheet metal members 38 and 39, during relative movement of both the intermediate portions 38*b* and 39*b*, the sheet material 14A may be bent by distortion or undergo a useless tensile force. In contrast, in this embodiment, the intermediate portion 39*b* of the back sheet metal member 39 is supported so as to slide on the sheet material 14A. For this reason, there is no case in which the sheet material 14A is bent by distortion or undergoes a useless tensile force during relative movement of both the intermediate portions 38*b* and 39*b*, and as a result, the maintenance sheet 14 can be transported in a satisfactory posture.

(5) The maintenance sheet 14 can be simply supported in a stretched state only by winding the single sheet material 14A around the intermediate portions 38*b* and 39*b* of the sheet metal members 38 and 39 so as to wrap around all the intermediate portions 38*b* and 39*b* in an endless shape. When the maintenance sheet 14 that is supported in a stretched state passes through the position opposite the nozzle forming surface 29*a* of the recording head 29, the sheet material 14A is interposed between the sheet metal members 38 and 39 and the nozzle forming surface 29*a*. For this reason, there is no case in which the sheet metal members 38 and 39 come into direct contact with the nozzle forming surface 29*a*. Therefore, the nozzle forming surface 29*a* of the recording head 29 can be prevented from being damaged due to the sheet metal members 38 and 39, and waste ink ejected from the nozzles 30 can be prevented from being stuck to the sheet metal members 38 and 39.

(6) When the sheet metal members 38 and 39, which support the maintenance sheet 14, move along the curved path portion, the inner circumferential surfaces 44*a* and 45*a* of the guide plates 44 and 45 are engaged with the sheet metal members 38 and 39. Accordingly, the sheet metal members 38 and 39 are guided so as to move along the path direction of the curved path portion. For this reason, there is no case in which the sheet metal members 38 and 39 are displaced outward of the curved path portion due to a centrifugal force. Therefore, the maintenance sheet 14, which moves along the curved path portion together with the sheet metal members 38 and 39 while being supported by the sheet metal members 38 and 39, is also prevented from being largely deformed outward of the curved path portion due to a centrifugal force. As a result, even if the maintenance sheet 14 for receiving ink ejected from the recording head 29 as waste ink is transported along the movement path including the curved path portion, the maintenance sheet 14 can be transported in a stable posture.

(7) The guide plate 44 on the upstream side in the transport direction X is provided with the cutout portion 46 that permits passing of the sheet 12, and a pair of guide plates 45 on the downstream side are spaced from each other by the space area 45*b* so as to permit passing the sheet 12. For this reason, when the sheet 12 is transported from the sheet feed tray to the sheet discharge tray in the transport direction X along the transport path, there is no case in which the guide plates 44 and 45 obstruct passing of the sheet 12, and as a result, smooth transport of the sheet 12 can be secured.

(8) In particular, with respect to the downstream-side guide plates 45, the ink receiving surface 14*b* of the maintenance sheet 14 with ink stuck thereto moves the position corresponding to the space area 45*b* between both the left and right downstream-side guide plates 45 along the curved path portion, together with the intermediate portions 38*b* and 39*b* of the sheet metal members 38 and 39. Therefore, the downstream-side guide plates 45 can be prevented from being contaminated due to ink stuck to the ink receiving surface of the maintenance sheet 14.

(9) With the upstream-side guide plate 44, the sheet 12 can be transported from the sheet feed tray onto the transport belt 23 through the cutout portion 46. When the maintenance sheet 14 moves the curved path portion on the upstream side before passing through the position opposite the nozzle forming surface 29*a*, the maintenance sheet 14 can be prevented from being displaced outward of the curved path portion. In this case, the sheet portion of the maintenance sheet 14, which tends to be displaced outward, comes into slide contact with a portion other than the cutout portion 46 in the upstream-side guide plate 44. Therefore, the maintenance sheet 14 can be more reliably prevented from being displaced. At this moment, since the maintenance sheet 14 is in a state before receiving ink to be ejected through flushing, there is no case in which the upstream-side guide plate 44 is contaminated with ink.

(10) When the maintenance sheet 14 moves along the curved path portion, the guide plates 44 and 45 smoothly bring the sheet metal members 38 and 39, which move while supporting the maintenance sheet 14, into slide contact with the arc-shaped inner circumferential surfaces 44*a* and 45*a*, which become engagement portions. Therefore, the movement direction can be smoothly guided.

(11) When the maintenance sheet 14 passes through the cleaning position, if the cleaning roller 50 is switched to the cleaning posture by the cleaning motor 49, ink stuck to the maintenance sheet 14 can be wiped by the circumferential surface of the arc portion 51 serving as a cleaning function portion of the cleaning roller 50. When it is not necessary to perform cleaning on the maintenance sheet 14, which passes through the cleaning position, for example, when the amount of ink stuck to the maintenance sheet 14 is small, if the cleaning roller 50 is switched to the non-cleaning posture by the cleaning motor 49, the cleaning roller 50 does not come into contact with the maintenance sheet 14 being moving. For this reason, the transport state of the maintenance sheet 14 by the sheet transport mechanism 15 can be satisfactorily maintained. Therefore, the maintenance sheet 14 for receiving ink ejected from the recording head 29 as waste ink can be cleaned with simple configuration, and as a result, the maintenance sheet 14 can be repeatedly used easily.

(12) Only if the cleaning roller 50 is rotated by the cleaning motor 49, if necessary, the cleaning roller 50 can be switched between the cleaning posture, in which the circumferential surface of the arc portion 51 serving as a cleaning function portion in the cleaning roller 50 comes into contact with the maintenance sheet 14 passing through the cleaning position, and the non-cleaning posture, in which the circumferential surface of the chord portion 52 serving as a non-cleaning function portion is opposite the maintenance sheet 14. Therefore, the maintenance sheet 14 can be repeatedly used more easily.

(13) The circumferential surface of the arc portion 51 of the cleaning roller 50 comes into contact with the central area 60, excluding the edge portions at both the front and back ends in the movement direction, of the maintenance sheet 14 passing through the cleaning position. For this reason, with the wiping action based on the contact, ink stuck to the maintenance sheet 14 can be prevented from being pushed out and flowing out of the edge portions of the maintenance sheet 14. The cleaning roller 50 does not come into contact with the edges of the maintenance sheet 14. As a result, the lifespan of the cleaning roller 50 can be extended.

(14) The cleaning roller 50 has the sectional shape of alphabet letter D, and can wipe ink stuck to the maintenance sheet 14 by once rotation. Therefore, the cleaning mechanism 48 that enables the maintenance sheet 14 to be repeatedly used can be implemented with simple configuration.

(15) The circumferential surface of the arc portion 51 of the cleaning roller 50 has an ink absorption action, in addition to the ink wiping action. For this reason, even if the arc portion 51 comes into contact with the maintenance sheet 14 with a slight contact pressure, ink stuck to the maintenance sheet 14 is easily removed. Therefore, the transport state of the maintenance sheet 14 by the sheet transport mechanism 15 can be further satisfactorily maintained.

(16) The control device 41 controls the driving state of the sheet transport motor 31 so as to appropriately adjust the transport velocity of the maintenance sheet 14 being transported. Therefore, the transport efficiency of the maintenance sheet 14 can be improved with simple configuration.

(17) In particular, when the maintenance sheet 14 passes through the path portion Z1 including the position opposite the nozzle forming surface 29*a*, the transport velocity can be adjusted so as to receive ink ejected from the recording head 29. Meanwhile, at the path portions Z2 and Z3, the transport velocity can be adjusted depending on the transport purposes of the path portions Z2 and Z3, and as a result, the transport purposes can be smoothly achieved.

(18) The control device 41 controls the driving state of the sheet transport motor 31 so as to circularly transport the maintenance sheet 14 from the standby position P through the first path portion Z1, the second path portion Z2, and the third path portion Z3 in that order. Therefore, the maintenance sheet 14 can be reused.

(19) At the first path portion Z1, the transport velocity of the maintenance sheet 14 is set so as to be identical to the transport velocity of the sheet 12 by the sheet transport mechanism 13. Therefore, the maintenance sheet 14 can be interruptively interposed between the previous sheet 12 and the subsequent sheet 12, which are sequentially transported from the upstream side to the downstream side along the transport path so as to pass through the position opposite the nozzle forming surface 29*a* by the sheet transport mechanism 13 and can be transported to the position opposite the nozzle forming surface 29*a*.

(20) At the second path portion Z2 where the cleaning mechanism 48 is provided, the maintenance sheet 14 is transported at a transport velocity lower than the transport velocity at the first path portion Z1. Therefore, the transport purpose at that time, that is, the cleaning of the maintenance sheet 14 can be effectively and reliably achieved.

(21) At the third path portion Z3 where the cleaned maintenance sheet 14 returns to the standby position P, the maintenance sheet 14 is transported at a transport velocity faster than the transport velocity at other path portions Z1 and Z2. For this reason, the maintenance sheet 14 can rapidly return to the standby position P. Therefore, it is possible to cope with frequent flushing using a small number of maintenance sheets 14, for example, a single maintenance sheet 14, and to appropriately cope with an increase in size of the printer 11 having a long path, through which the maintenance sheet 14 is transported.

(22) When the maintenance sheet 14 passes through the position opposite the nozzle forming surface 29*a*, the control device 41 controls the ink ejection timing from the nozzles 30 of the recording head 29 such that ink ejected from the nozzles 30 as a waste liquid is received by the rectangular ink receiving area 40 on the ink receiving surface 14*b* of the maintenance sheet 14. Therefore, during flushing, ink can be prevented from flying outside the edge portions of the maintenance sheet 14, and as a result, contamination in and around the transport belt 23 serving as the transport path of the sheet 12 can be suppressed.

(23) During flushing, if the maintenance sheet 14, which is transported to the downstream side in the transport direction X by the sheet transport mechanism 15, approaches the position opposite to the nozzle forming surface 29*a*, this approach is detected by the optical sensor 42, and the detection signal is output. The control device 41 controls the ink ejection timing from the nozzles 30 of the recording head 29 on the basis of the detection signal. Therefore, the maintenance sheet 14 accurately receives ink within the ink receiving area 40 set at the central portion of the ink receiving surface 14*b*.

(24) In this case, when there are a plurality of nozzle columns in the transport direction X of the maintenance sheet 14, the ink ejection timing can be controlled for each nozzle column. Therefore, the maintenance sheet 14 can more accurately receive ink within the ink receiving area 40.

(25) During flushing, the maintenance sheet 14 receives ink within the ink receiving area 40 at the central portion, excluding the edge portions in the movement direction, on the ink receiving surface 14*b*. Therefore, when ink stuck to the cleaning roller 50 is wiped on the downstream side later, ink can be prevented from being pushed out of the edge portions outward of the maintenance sheet 14.

(26) During cleaning, the cleaning roller 50 takes the wiping action for the ink receiving surface 14*b* of the liquid-repellant maintenance sheet 14 with a contact pressure. Therefore, stuck ink can be effectively removed.

(27) During maintenance of the sheet transport mechanism 13, the entire mechanism unit 13A can be removed from the printer 11, and maintenance can be performed. Therefore, various maintenance works including replacement of the transport belt 23 and the like can be simply performed without removing the sheet transport mechanism 15.

(28) The circular path of the transport belt 23 in the sheet transport mechanism 13 is provided inside the circular path of the chains 37 in the sheet transport mechanism 15. Therefore, the printer 11 can be reduced in size.

(29) In the printer 11, the attachment/detachment portions that enable the mechanism unit 13A of the sheet transport mechanism 13 to be attached and detached are formed by the shaft receiving portions 22*a* having the holes or openings formed at the inner surface of the second support plate 22, which is fixed to the printer 11. The shaft portions 17*a* to 20*a* of the pulleys 17 to 20 in the sheet transport mechanism 13 are able to be inserted and withdrawn with respect to the shaft receiving portions 22*a*, respectively. Therefore, only by movement in the insertion and withdrawal direction of the shaft portions 17*a* to 20*a* of the pulleys 17 to 20 with respect to the shaft receiving portions 22*a*, the mechanism unit 13A of the sheet transport mechanism 13 can be easily attached and detached.

(30) When the mechanism unit 13A of the sheet transport mechanism 13 is attached and detached with respect to the printer 11, the first support plate 21 serving as a support in the mechanism unit 13A functions as a holding portion. Therefore, attachment and detachment can be performed while the mechanism unit 13A can be stably held.

(31) The configuration in which the entire mechanism unit 13A of the sheet transport mechanism 13 can be attached and detached can be realized by the configuration in which the shaft portions 17*a* to 20*a* of the pulleys 17 to 20 with the transport belt 23 wound therearound in the sheet transport mechanism 13 are configured so as not to be aligned with the shaft portions of the sprockets 32 to 36 with the chains 37 wound therearound in the sheet transport mechanism 15.

(32) When stopping at the standby position P, the maintenance sheet 14 faces the tension pulley 20 of the sheet transport mechanism 13 with the transport belt 23 sandwiched therebetween, and comes into contact with the surface 23*a* of the transport belt 23 with a difference in velocity. For this reason, the surface 23*a* of the transport belt 23 that circularly moves in order to transport the sheet 12 can be wiped by the maintenance sheet 14, and the surface 23*a* of the transport belt 23, to which paper dust or particles are likely to be stuck, can be cleaned.

(33) The surface 23*a* of the transport belt 23 is cleaned by the maintenance sheet 14 when the maintenance sheet 14 stops at the standby position P, and the printer 11 is in operation, that is, the transport belt 23 continuously circularly moves. Therefore, the transport belt 23 can be cleaned without deteriorating throughput.

(34) In this case, the rear surface of the maintenance sheet 14 in contact with the surface 23*a* of the transport belt 23 is the brush surface 43 having a plurality of fabrics in a brush shape. Therefore, the surface 23*a* of the transport belt 23 can be efficiently cleaned.

(35) When the cleaning roller 50 of the cleaning mechanism 48 cleans the maintenance sheet 14 at the cleaning position, the cleaning roller 50 faces the tension pulley 19 in the sheet transport mechanism 13 with the maintenance sheet 14 sandwiched therebetween, and the circumferential surface of the arc portion 51 serving as a cleaning function portion comes into contact with the ink receiving surface 14*b* of the maintenance sheet 14. Therefore, there is no case in which the flexible maintenance sheet 14 gets loose from the cleaning roller 50 and bent due to a contact pressure of the cleaning roller 50. As a result, the cleaning function can be satisfactorily secured.

(36) At the cleaning position, the circular path of the transport belt 23 and the transport path of the maintenance sheet 14 by the sheet transport mechanism 15 overlap each other. Accordingly, when the maintenance sheet 14 passes through the cleaning position, the cleaning roller 50 comes into contact with the maintenance sheet 14, and when the maintenance sheet 14 does not pass through, the cleaning roller 50 comes into contact with the surface 23*a* of the transport belt 23. Therefore, the single cleaning roller 50 can have a plurality of functions, that is, cleaning (wiping) of the transport belt 23 and cleaning of the maintenance sheet 14.

(37) The cleaning roller 50 is urged by the spring member 54 so as to come into contact with the maintenance sheet 14. For this reason, the cleaning roller 50 can strongly perform cleaning on the maintenance sheet 14 in combination with a sandwich force with the tension pulley 19. Meanwhile, the cleaning roller 50 comes into light contact with the surface 23*a* of the transport belt 23 since the urging force of the spring member 54 does not reach. Therefore, the wiping action can be exerted, but there is weak resistance against the circular movement of the transport belt 23. As a result, there is no case in which the sheet transport efficiency in the sheet transport mechanism 13 is deteriorated.

(38) During cleaning of the maintenance sheet 14, as a sandwich member facing the cleaning roller 50 with the maintenance sheet 14 sandwiched therebetween, the tension pulley 19 in the sheet transport mechanism 13 can be used. Therefore, an increase in the number of parts can be suppressed, and a multi-functional cleaning function can be obtained.

(39) In the sheet transport mechanism 15, a mobile member for transporting the maintenance sheet 14 along the circular path is formed by the chains 37. For this reason, the chains 37 are not extended, as compared with a case in which the mobile member is formed by a belt. Therefore, it is possible to improve transport accuracy of the maintenance sheet 14, and to cope with an increase in size of the printer 11 having a long mobile member movement path.

The above-described embodiment may be embodied as the following modifications.

Figure 11:
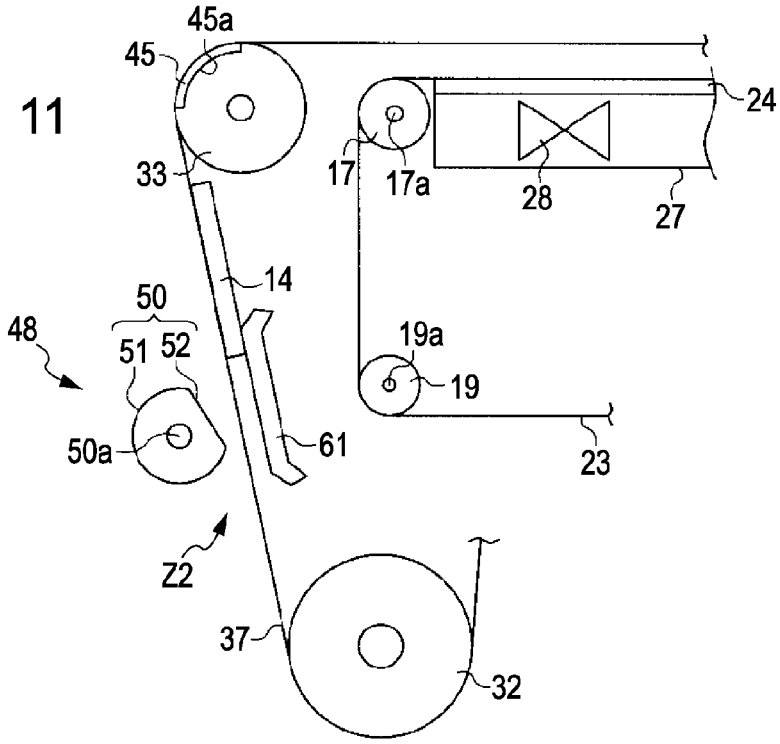
FIG. 11 is a schematic view illustrating a cleaning mechanism according to a modification.

As shown in FIG. 11, the driving sprocket 32 in the sheet transport mechanism 15 may be disposed immediately below the front tension pulley 19 of the sheet transport mechanism 13, such that the circular path of the transport belt 23 and the second path portion Z2 of the maintenance sheet 14 to be transported by the chains 37 do not overlap each other around the tension pulley 19. In this case, a support stand 61 may be disposed inside the circular path of the chains 37 at the cleaning position as a sandwich member so as to face the cleaning roller 50 with the maintenance sheet 14 passing through the cleaning position sandwiched therebetween. In this case, the cleaning roller 50 may not be urged toward the support stand 61 by a spring member. With this configuration, cleaning can be performed while the maintenance sheet 14 is sandwiched between the cleaning roller 50 and the support stand 61.

Figure 12:
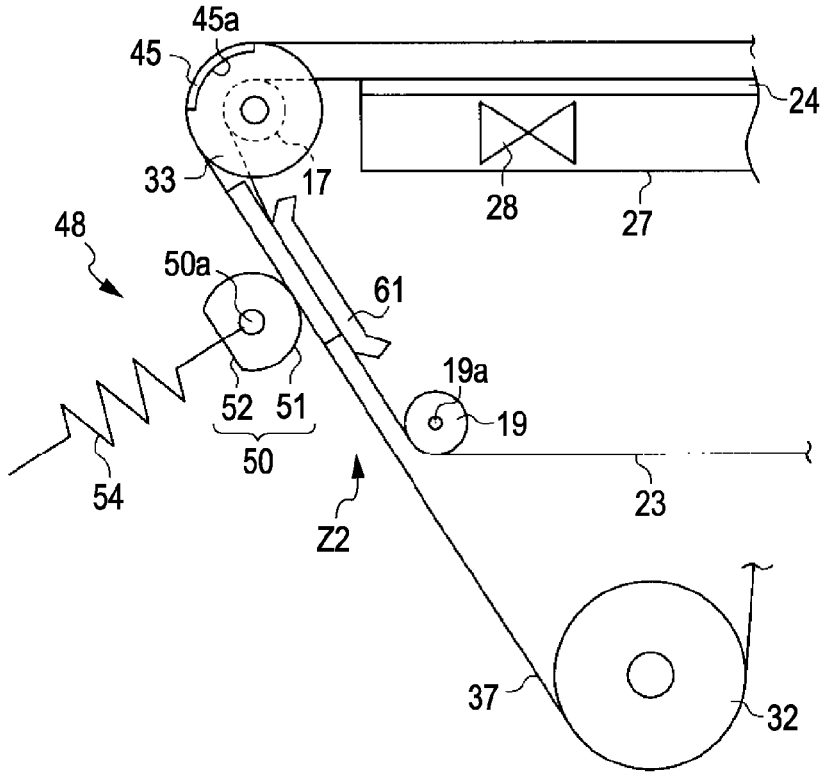
FIG. 12 is a schematic view illustrating a cleaning mechanism according to another modification.

As shown in FIG. 12, the driving pulley 17 in the sheet transport mechanism 13 may be coaxially disposed between both the left and right driven sprockets 33 on the front side in the sheet transport mechanism 15, such that the circular path of the transport belt 23 and the second path portion Z2 of the maintenance sheet 14 overlap each other between the driving pulley 17 (and the driven sprocket 33) and the tension pulley 19. In this case, a support stand 61 may be disposed inside the circular path of the chains 37 at the cleaning position as a sandwich member so as to face the cleaning roller 50 with the maintenance sheet 14 passing through the cleaning position sandwiched therebetween. With this configuration, cleaning can be performed while the maintenance sheet 14 is sandwiched between the cleaning roller 50 and the support stand 61.

Figure 13:
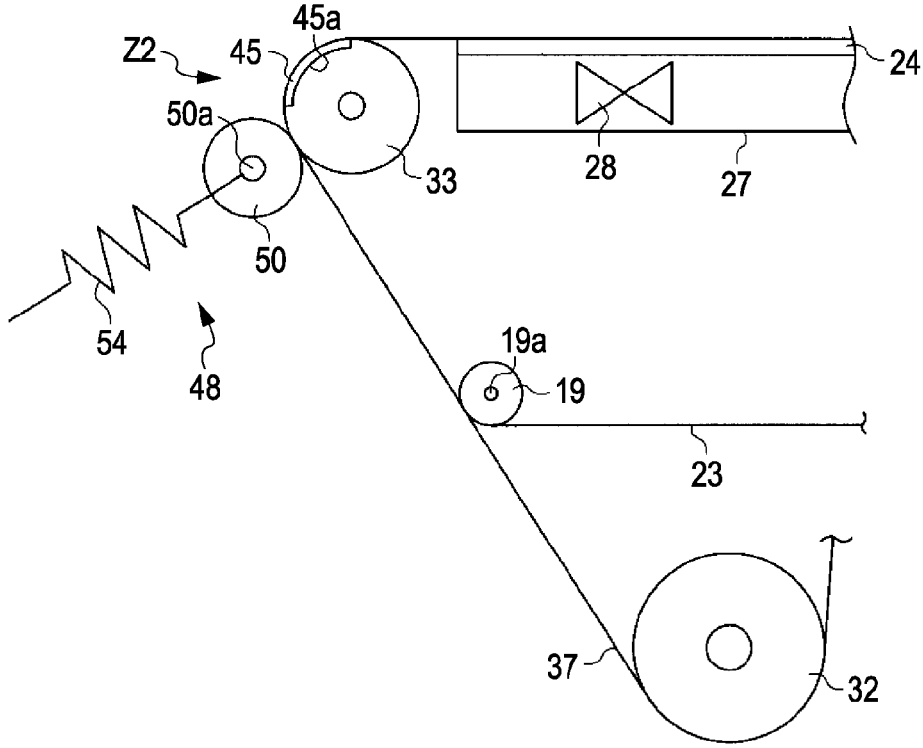
FIG. 13 is a schematic view illustrating a cleaning mechanism according to yet another modification.

As shown in FIG. 13, the driving pulley of the sheet transport mechanism 13 may be provided between both the left and right driven sprockets 33 on the front side in the sheet transport mechanism 15 so as to be disposed coaxially with the driven sprocket 33 at the same diameter. The cylindrical cleaning roller 50 may be urged by the spring member 54 so as to come into rolling contact with the circumferential surface of the driving pulley. With this configuration, cleaning can be performed while the maintenance sheet 14 is sandwiched between the cleaning roller 50 and the driving pulley serving as a sandwich member. In this case, the cleaning roller 50 can have a function to clean the maintenance sheet 14, and a function to wipe the surface 23*a* of the transport belt 23.

Figure 14A:
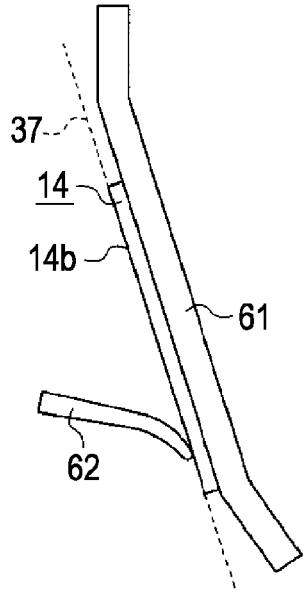
FIGS. 14A to 14D are schematic views illustrating a cleaning mechanism according to modifications.
Figure 14B:
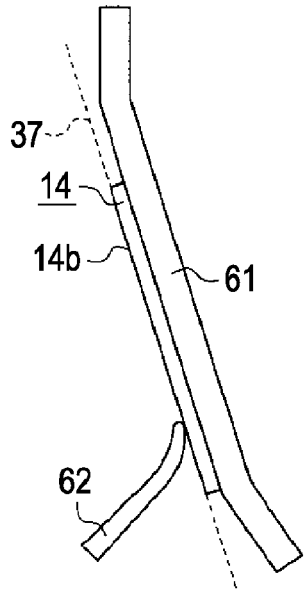

As shown in FIGS. 14A and 14B, instead of the cleaning roller 50, a resin or rubber blade 62 having a curved front end may be used as a cleaning member. In this case, cleaning may be performed in order to remove ink stuck to the maintenance sheet 14 while the maintenance sheet 14 is sandwiched between the blade 62 and the support stand 61.

Figure 14C:
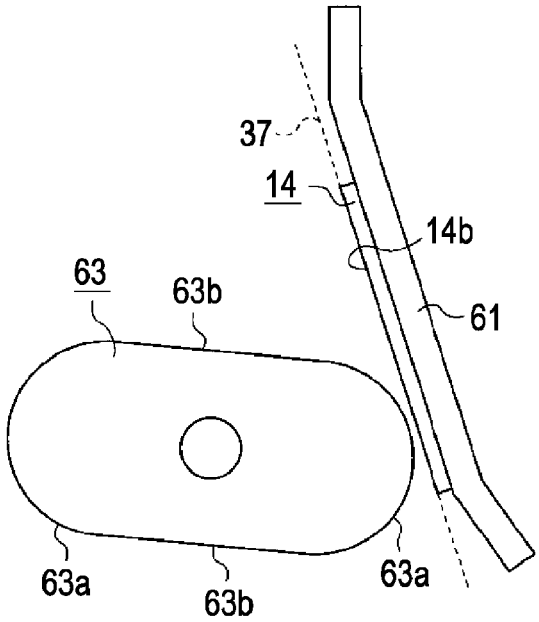

As shown in FIG. 14C, as the cleaning roller, a cleaning roller 63 having a rectangular round shape in section may be used. The cleaning roller 63 has two curved portions 63*a* serving as a cleaning function portion and two planar portions 63*b* serving as a non-cleaning portion.

Figure 14D:
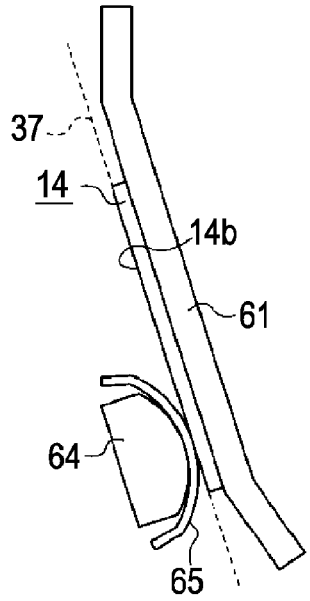

As shown in FIG. 14D, a cleaning member may be formed by a press jig 64 having a convex surface and a liquid absorbing sheet 65. In this case, the press jig 64 presses the liquid absorbing sheet 65 against the maintenance sheet 14 at the convex surface by an urging member (not shown), and wiping is performed while the maintenance sheet 14 is sandwiched between the support stand 61 and the liquid absorbing sheet 65.

Figure 15A:
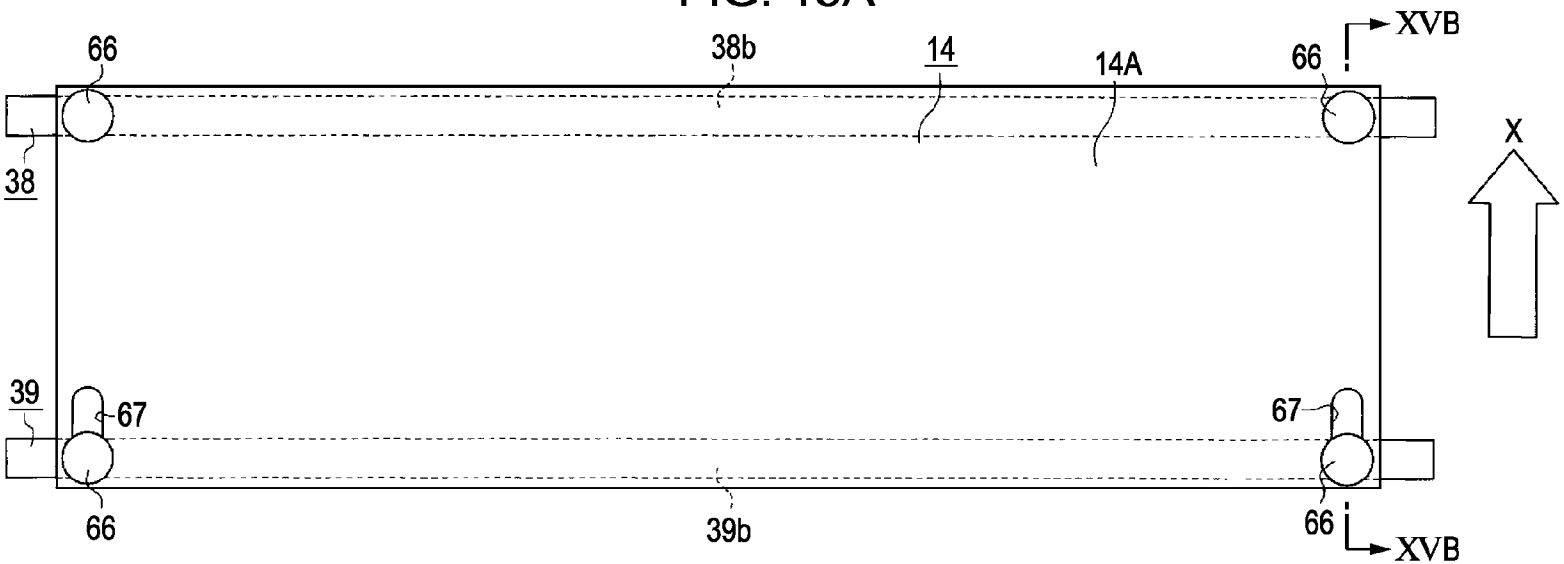
FIG. 15A is a schematic plan view illustrating a maintenance sheet according to a modification.
Figure 15B:
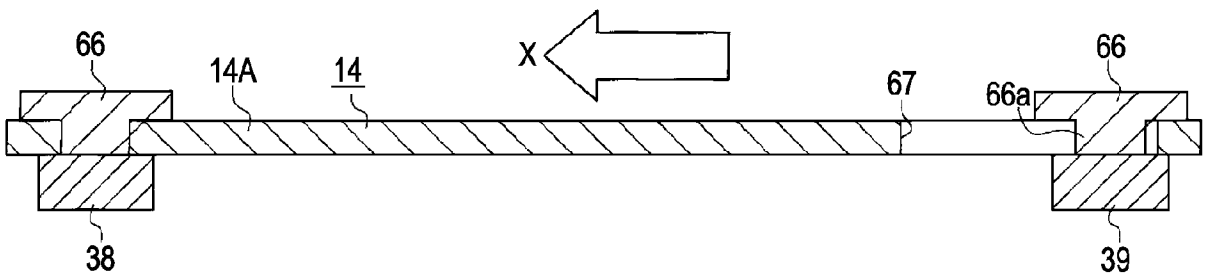
FIG. 15B is a schematic sectional view of a maintenance sheet taken along the line XVB-XVB of FIG. 15A.

As shown in FIGS. 15A and 15B, the sheet material 14A constituting the maintenance sheet 14 may be fixed to the upper surface of a pair of front and back sheet metal members 38 and 39 by screws 66. In this case, the front end portion of the sheet material 14A is relatively unmovably fixed to the intermediate portion 38*b* of the sheet metal member 38 on the front side in the transport direction X, and the back end portion of the sheet material 14A is relatively movably (that is, slidably) supported by the intermediate portion 39*b* of the sheet metal member 39 on the back side. Specifically, at the positions of the sheet material 14A corresponding to the positions where the screws 66 are provided, long holes 67 are formed in the transport direction (movement direction) X of the maintenance sheet 14, and shafts (convex portions) 66*a* of the screws 66 are slidably inserted into the long holes 67, respectively.

With this configuration, the sheet material 14A constituting the maintenance sheet 14 can be simply supported in a stretched state by the front and back sheet metal members 38 and 39. Accordingly, when the sheet material 14A and the sheet metal members 38 and 39 supporting the sheet material 14A pass through an arc-shaped curved path portion, the shafts (convex portions) 66*a* of the screws 66 provided at the intermediate portion 39*b* of the last sheet metal member 39 slide within the long holes 67 of the sheet material 14A in the movement direction. Therefore, the sheet material 14A can be prevented from being bent by distortion or undergoing a useless tensile force.

In the foregoing embodiment, three or more sheet metal members 38 and 39 may support the maintenance sheet 14. In this case, preferably, the front end portion of the maintenance sheet 14 is fixed to the intermediate portion of the first sheet metal member, and the back end portion of the maintenance sheet 14 is slidably supported by the intermediate portions of other sheet metal members.

In the foregoing embodiment, a single sheet metal member may be used. In this case, with respect to the sheet material 14A constituting the maintenance sheet 14, the front end portion may be fixed to the intermediate portion of the single sheet metal member, and the back end portion may be in a free end state. With this configuration, as the single sheet metal member moves together with the chains 37, the maintenance sheet 14 is transported in a state stretched backward in the movement direction.

In the foregoing embodiment, the mobile member of the sheet transport mechanism 15 may be a wheel body having a wire or the like or an endless belt body, instead of the chains 37, which are chain members.

In the foregoing embodiment, the movement spaces of the chains 37 and the end portions 38*a* and 39*a* of the sheet metal members 38 and 39 connected to the connection pieces 37*a* may be space areas between both the left and right support plates 21 and 22 insofar as they are located on a side opposite to the surface 23*a* (transport plane) of the transport belt 23 when viewed from the nozzle forming surface 29*a*. In this case, the sheet metal members 38 and 39 have a substantially U shape, not being bent in a crank shape.

In the modification shown in FIGS. 15A and 15B, the long holes 67, which are formed in the sheet material 14A constituting the maintenance sheet 14, may be so-called gourd-shaped long holes, in which a back portion in the sheet transport direction has a width in the longitudinal direction larger than that of a front portion. In this case, attachment/detachment and replacement of the maintenance sheet 14 (the sheet material 14A) become simplified.

In the foregoing embodiment, the sectional shapes of the guide plates 44 and 45 may be bent in an elliptical shape or a polygonal shape insofar as they follow in the circumferential directions of the driven sprockets 33 and 34, respectively. In summary, the sectional shapes of the guide plates 44 and 45 are not limited to an arc shape insofar as the maintenance sheet 14 and the sheet metal members 38 and 39 supporting the maintenance sheet 14 can be prevented from being largely deformed outward when passing through the curved path portion.

In the foregoing embodiment, the upstream-side guide plate 44 and the downstream-side guide plates 45 may be the same.

In the foregoing embodiment, with respect to the guide plates 44 and 45, if at least the downstream-side guide plates 45 are provided, the upstream-side guide plate 44 may not be necessarily provided.

In the foregoing embodiment, the guide plates may be provided at positions corresponding to the outer circumferences of the sprockets 32, 35, and 36 other than the driven sprockets 33 and 34, for example, at the curved path portion along the circumferential direction of the driving sprocket 32.

In the foregoing embodiment, both the left and right end portions of the intermediate portions 38*b* and 39*b* of the sheet metal members 38 and 39 may be directly engaged with the inner circumferential surfaces 44*a* and 45*a* serving as engagement portions of the guide plates 44 and 45. In this case, preferably, the width of the sheet material 14A in the left-right direction is made small.

In the foregoing embodiment, when the cleaning roller 50 comes into rolling contact with the maintenance sheet 14, the cleaning roller 50 may rotate in any direction.

In the foregoing embodiment, the cleaning roller 50 may come into contact with the maintenance sheet 14 without rotating and perform cleaning to wipe stuck ink.

In the foregoing embodiment, only the circumferential surface of the arc portion 51 serving as a cleaning function portion in the cleaning roller 50 may have a liquid-absorption property.

In the foregoing embodiment, the cleaning roller 50 may be a roller having a circular sectional shape, as shown in FIG. 13.

In the foregoing embodiment, the cleaning roller 50 may be manually switched between the cleaning posture and the non-cleaning posture, not depending on rotation of the cleaning motor 49. Alternatively, a switching mechanism, such as a cam mechanism or the like, may be separately provided.

In the foregoing embodiment, the cleaning roller 50 may come into contact with the entire ink receiving surface 14*b* of the maintenance sheet 14.

In the foregoing embodiment, the sheet transport mechanism 15 may have chains that reciprocate along a non-endless path, not the chains 37 that move along the circular movement path.

In the foregoing embodiment, if the transport velocity of the maintenance sheet 14 is faster at the third path portion Z3 than at the first path portion Z1, the transport velocity at the second path portion Z2 where cleaning is performed may be identical to the transport velocity at the first path portion Z1.

In the foregoing embodiment, if the transport velocity of the maintenance sheet 14 is slower at the second path portion Z2 than at the first path portion Z1, the transport velocity at the third path portion Z3 where the maintenance sheet 14 returns to the standby position P may be identical to the transport velocity at the first path portion Z1.

In the foregoing embodiment, the transport velocity of the maintenance sheet 14 at the first path portion Z1 may be identical to the transport velocity of the sheet 12 when the transport interval between the previous sheet 12 and the subsequent sheet 12 in the sheet transport mechanism 13 is sufficiently large or when the sheet 12 stops to be transported during flushing.

In the foregoing embodiment, the transport velocity of the maintenance sheet 14 may include two kinds of velocity including the velocity at the first path portion Z1 and the velocity at other path portions Z2 and Z3.

In the foregoing embodiment, during flushing, waste ink may be ejected onto the ink receiving surface 14*b* of the maintenance sheet 14 passing through the position opposite the nozzle forming surface 29*a* from all the nozzles 30 simultaneously.

In the foregoing embodiment, the control device 41 may calculate the timing, at which waste ink is ejected into the ink receiving area 40 of the maintenance sheet 14 during flushing, on the basis of a time elapsed after the maintenance sheet 14 starts to move from the standby position P. With this configuration, the optical sensor 42 is not needed. In this case, the standby position P becomes the reference position.

In the foregoing embodiment, with respect to the maintenance sheet 14, a portion to be detected may be provided at a position corresponding to the ink receiving area 40 in the front-back direction (movement direction) of the maintenance sheet 14. With respect to the recording head 29, a detection unit may be provided at a position corresponding to the nozzles 30 (nozzle column). In this case, when the maintenance sheet 14 passes through the position opposite the nozzle forming surface 29*a*, ink may be ejected with timing at which the detection unit detects a portion to be detected.

In the foregoing embodiment, the control device 41 may store in advance a time required from when the maintenance sheet is transported and passes through the reference position (or starts to move), for example, the standby position P or the like until the maintenance sheet reaches the position opposite the nozzle forming surface 29*a*. In this case, ink may be ejected when the stored time has elapsed.

In the foregoing embodiment, the cleaning mechanism 48 may be freely attached and detached with respect to the printer 11.

In the foregoing embodiment, as a holding portion that the user holds in order to attach and detach the mechanism unit 13A of the sheet transport mechanism 13 with respect to printer 11, a holding arm may be provided, instead of the first support plate 21.

In the foregoing embodiment, when the mechanism unit 13A of the sheet transport mechanism 13 is attached and detached with respect to the printer 11, the first support plate 21, the pulleys 17 to 20, and the transport belt 23 may be individually attached and detached.

In the foregoing embodiment, a transport roller may be used as a target transport member insofar as it can transport the sheet 12 in the transport direction X by rotation, and can be handled integrally with the first support plate 21 serving as a support in the mechanism unit 13A.

In the foregoing embodiment, as the attachment/detachment portions that enable the mechanism unit 13A of the sheet transport mechanism 13 to be attached and detached with respect to the printer 11, other configuration for free attachment and detachment, such as a support frame or the like, may be used, instead of the shaft receiving portions 22*a*.

In the foregoing embodiment, the rear surface of the maintenance sheet 14 coming into contact with the surface 23*a* of the transport belt 23 at the standby position P may be an adhesive surface and a liquid-absorbent surface, instead of the brush surface 43, so as to function as a cleaning function surface. The brush surface 43 may partially have a brush shape, not over the entire surface thereof.

In the foregoing embodiment, the maintenance sheet 14 is not necessarily limited to the configuration in which the brush surface 43 on the rear side thereof comes into contact with the transport belt 23 in a standstill state, insofar as the brush surface 43 comes into contact with the transport belt 23 with a different in velocity. Therefore, if the difference in velocity occurs, the maintenance sheet 14 may circularly move at a velocity higher than the circular velocity of the transport belt 23, and pass the transport belt 23 to wipe the surface 23*a* of the transport belt 23.

In the foregoing embodiment, the cleaning mechanism 48 may include a plurality of cleaning members, such as a roller, a blade, a liquid absorbing sheet, and the like, and may rearrange the cleaning members so as to be selectively used.

What is claimed is:

1. A liquid ejecting apparatus comprising:

a liquid ejecting head disposed on a transport path of a target to eject a liquid from nozzles at a nozzle forming surface;

a target transport unit transporting the target such that the target passes through a position opposite the nozzle forming surface on the transport path; and a liquid receptor transport unit transporting a liquid receptor for receiving the liquid ejected from the nozzles as a waste liquid such that the liquid receptor passes through the position opposite the nozzle forming surface on the transport path, wherein, with rotation of the target transport unit, a mechanism unit including a target transport member for transporting the target in a transport direction is able to be attached and detached at a certain position out of a mechanism portion of the liquid receptor transport unit with respect to the liquid ejecting apparatus.

2. The liquid ejecting apparatus according to claim 1, wherein the target transport member is an endless transport belt, the mechanism unit includes a plurality of pulleys around which the transport belt is wound so as to form an circular path, and a support rotatably supporting the pulleys, and the mechanism unit is handled integrally in a mechanism unit basis in a state where the pulleys are rotatably combined with the support and the transport belt is wound between the pulleys.

3. The liquid ejecting apparatus according to claim 1, wherein the liquid receptor transport unit includes an endless mobile member moving along a circular movement path to transport the liquid receptor, the mechanism unit in the target transport unit is able to be attached and detached inside the circular movement path of the mobile member in the liquid receptor transport unit.

4. The liquid ejecting apparatus according to claim 3, wherein the mechanism unit is attached and detached with respect to the liquid ejecting apparatus by moving the entire mechanism unit along an axis when the target transport member rotates.

5. The liquid ejecting apparatus according to claim 4, further comprising:

an attachment/detachment portion, into and from which a part of the mechanism unit is able to be inserted and withdrawn when the mechanism unit is moved to be attached and detached.

* * * * *